US006936972B2

(12) United States Patent
Takeuchi et al.

(10) Patent No.: US 6,936,972 B2
(45) Date of Patent: Aug. 30, 2005

(54) ELECTRON-EMITTING ELEMENT AND FIELD EMISSION DISPLAY USING THE SAME

(75) Inventors: Yukihisa Takeuchi, Nishikamo-Gun (JP); Tsutomu Nanataki, Toyoake (JP); Iwao Ohwada, Nagoya (JP); Tomoya Horiuchi, Nishikasugai-Gun (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/286,451

(22) Filed: Nov. 1, 2002

(65) Prior Publication Data

US 2003/0098656 A1 May 29, 2003

Related U.S. Application Data

(63) Continuation-in-part of application No. 10/206,409, filed on Jul. 26, 2002, which is a continuation-in-part of application No. 10/027,232, filed on Dec. 20, 2001.

(30) Foreign Application Priority Data

Dec. 22, 2000 (JP) ..... 2000-390299
Feb. 26, 2002 (JP) ..... 2002-049754
Jun. 24, 2002 (JP) ..... 2002-183481

(51) Int. Cl.[7] ..... G09G 3/10; H01J 9/02
(52) U.S. Cl. ..... 315/169.3; 445/6; 445/24
(58) Field of Search ..... 315/169.3, 169.1–169, 315/169.4; 313/309, 351, 336; 445/6, 24, 51

(56) References Cited

U.S. PATENT DOCUMENTS 5,191,217 A * 3/1993 Kane et al. ..... 250/423 F
5,280,221 A 1/1994 Okamoto et al. ..... 315/169.1
5,442,255 A * 8/1995 Ise et al. ..... 313/495
5,453,661 A 9/1995 Auciello et al. ..... 315/1

(Continued)

FOREIGN PATENT DOCUMENTS

| | | |
|---|---|---|
| DE | 3833604 | 4/1990 |
| DE | 10057072 | 5/2001 |
| EP | 0 353 632 | 2/1990 |
| EP | 428853 | 5/1991 |
| EP | 0 953 958 A2 | 11/1999 |
| FR | 2639151 | 5/1990 |
| FR | 2675306 | 10/1992 |
| FR | 2789221 | 8/2000 |
| FR | 2789223 | 8/2000 |
| JP | 44-26125 | 11/1969 |
| JP | 46-20944 | 6/1971 |

(Continued)

OTHER PUBLICATIONS

*Electron Emission from Ferroelectric Cathodes Excited by Pulsed Voltage*, Masatoshi Miyake et al. (Tokyo Institute of Technology), T. IEE Japan, vol. 119–A, No. 5, '99, pp. 622–627.
*Pulsed Electron Source Using a Ferroelectric Cathode,* Kiochi Yasuoka et al. (Tokyo Institute of Technology), vol. 68, No. 5, '99, pp. 546–550.
*On the Mechanism of Emission from the Ferroelectric Ceramic Cathode,* Victor F. Puchkarev et al., J. App. Phys. 78 (9), Nov. 1, 1995, pp. 5633–5637.

(Continued)

*Primary Examiner*—Don Wong
*Assistant Examiner*—Chuc Tran
(74) *Attorney, Agent, or Firm*—Burr & Brown

(57) ABSTRACT

An electron-emitting element is provided, including an electric field applying portion composed of a dielectric, a first electrode formed on one surface of the electric field applying portion, and a second electrode formed on the surface and forming a slit in cooperation with the first electrode, and which is formed on a substrate.

32 Claims, 23 Drawing Sheets

U.S. PATENT DOCUMENTS

| | | | | | |
|---|---|---|---|---|---|
| 5,508,590 | A | | 4/1996 | Sampayan et al. | 315/169.1 |
| 5,666,019 | A | | 9/1997 | Potter | 313/306 |
| 5,726,524 | A | | 3/1998 | Debe | 313/309 |
| 5,729,094 | A | | 3/1998 | Geis et al. | 315/169.1 |
| 5,747,926 | A | | 5/1998 | Nakamoto et al. | 313/495 |
| 5,760,535 | A | * | 6/1998 | Moyer et al. | 313/309 |
| 5,874,802 | A | | 2/1999 | Choi et al. | 313/495 |
| 5,877,594 | A | | 3/1999 | Miyano et al. | 315/169.1 |
| 5,929,560 | A | * | 7/1999 | Trujillo et al. | 313/495 |
| 5,977,696 | A | * | 11/1999 | Okamoto | 313/309 |
| 5,990,605 | A | | 11/1999 | Yoshikawa et al. | 313/310 |
| 6,040,973 | A | | 3/2000 | Okamoto et al. | 361/235 |
| 6,153,978 | A | | 11/2000 | Okamoto | 315/169.3 |
| 6,157,145 | A | | 12/2000 | Vollkommer et al. | 315/339 |
| 6,184,612 | B1 | | 2/2001 | Negishi et al. | 313/310 |
| 6,198,225 | B1 | | 3/2001 | Kano et al. | 101/363 |
| 6,267,636 | B1 | * | 7/2001 | Onishi et al. | 445/6 |
| 6,274,881 | B1 | | 8/2001 | Akiyama et al. | 257/10 |
| 6,285,123 | B1 | | 9/2001 | Yamada et al. | 313/495 |
| 6,313,815 | B1 | | 11/2001 | Takeda et al. | 345/75.2 |
| 6,359,383 | B1 | | 3/2002 | Chuang et al. | 313/496 |
| 6,364,730 | B1 | * | 4/2002 | Jaskie et al. | 445/24 |
| 6,435,928 | B1 | * | 8/2002 | Tsukamoto | 445/24 |
| 6,452,328 | B1 | | 9/2002 | Saito et al. | 313/495 |
| 6,469,452 | B2 | | 10/2002 | Seo et al. | 315/169.4 |
| 6,479,924 | B1 | | 11/2002 | Yoo | 313/310 |
| 6,580,108 | B1 | | 6/2003 | Utsumi et al. | 257/288 |
| 2002/0060516 | A1 | | 5/2002 | Kawate et al. | 313/495 |
| 2004/0061431 | A1 | | 4/2004 | Takeuchi et al. | 313/495 |
| 2004/0066133 | A1 | | 4/2004 | Takeuchi et al. | 313/495 |
| 2004/0090398 | A1 | | 5/2004 | Takeuchi et al. | 345/75.2 |
| 2004/0100200 | A1 | | 5/2004 | Takeuchi et al. | 315/169.3 |
| 2004/0104684 | A1 | | 6/2004 | Takeuchi et al. | 315/169.1 |
| 2004/0104689 | A1 | | 6/2004 | Takeuchi et al. | 315/169.4 |
| 2004/0104690 | A1 | | 6/2004 | Takeuchi et al. | 315/169.4 |
| 2004/0113561 | A1 | | 6/2004 | Takeuchi et al. | 315/169.3 |

FOREIGN PATENT DOCUMENTS

| | | | |
|---|---|---|---|
| JP | 59-208587 | | 11/1984 |
| JP | 63-150837 | A | 6/1988 |
| JP | 1-311533 | | 12/1989 |
| JP | 05-325777 | A1 | 12/1993 |
| JP | 7-147131 | | 6/1995 |
| JP | 08-111166 | A1 | 4/1996 |
| JP | 09-090882 | A | 4/1997 |
| JP | 10-27539 | A | 1/1998 |
| JP | 11-185600 | | 7/1999 |
| JP | 11-288249 | A | 10/1999 |
| JP | 2000-285801 | | 10/2000 |
| JP | 2000-310970 | A | 11/2000 |
| JP | 3160213 | B2 | 2/2001 |
| JP | 3214256 | B2 | 7/2001 |
| WO | 02/052600 | A1 | 7/2002 |

OTHER PUBLICATIONS

*Electron Emission from Ferroelectrics—A Review*, H. Riege, Nuclear Instruments and Methods in Physics Research, A340(1994), pp. 80–89.

U.S. Appl. No. 10/459,415, filed Jun. 11, 2003, Takeuchi et al.

U.S. Appl. No. 10/647,794, filed Aug. 25, 2003, Takeuchi et al.

U.S. Appl. No. 10/719,521, filed Nov. 21, 2003, Takeuchi et al.

U.S. Appl. No. 10/731,901, filed Dec. 9, 2003, Takeuchi et al.

U.S. Appl. No. 10/808,258, filed Mar. 24, 2004, Takeuchi et al.

U.S. Appl. No. 10/901,932, filed Jul. 29, 2004, Takeuchi et al.

U.S. Appl. No. 10/919,678, filed Aug. 17, 2004, Takeuchi et al.

U.S. Appl. No. 10/919,747, filed Aug. 17, 2004, Takeuchi et al.

U.S. Appl. No. 10/730,754, filed Dec. 8, 2003, Takeuchi et al.

U.S. Appl. No. 10/951,509, filed Sep. 28, 2004, Takeuchi et al.

U.S. Appl. No. 10/950,976, filed Sep. 27, 2004, Takeuchi et al.

U.S. Appl. No. 10/951,832, filed Sep. 28, 2004, Takeuchi et al.

U.S. Appl. No. 10/952,524, filed Sep. 28, 2004, Takeuchi et al.

"Pulsed Electron Source Using a Ferroelectric Cathode," Tokyo Institute of Technology, vol. 68, No. 5, Jan. 7, 1999, pp. 546–550.

Puchkarev, Victor F. and Mesyats, Gennady A., "On the Mechanism of Emission from the Ferroelectric Ceramic Cathode," Journal of Applied Physics, vol. 78, No. 9, Nov. 1, 1995, pp. 5633–5637.

Riege, H., "Electron Emission from Ferroelectrics –a Review," Nucl. Instr. and Meth. A340, 1994, pp. 80–89.

Masatoshi Miyake et al., "Electron Emission from Ferroelectric Cathodes Excited by Pulsed Voltage," Tokyo Institute of Technology, vol. 119, No. 5, 1999 pp. 622–627.

G. Benedek et al., "Electron Emission From Ferroelectric/Antiferroelectric Cathodes Excited by Short High–Voltage Pulses," Journal Applied Physics, vol. 81, No. 3, Feb. 1, 1997, pp. 1396–1403.

Gundel, H. et al., "Low Pressure Hollow Cathode Switch Triggered by a Pulsed Electron Beam Emitted From Ferroelectrics," Applied Physics Letter, American Institute of Physics, New York, US vol. 54, No. 21, May 22, 1989, pp. 2071–2073.

Gundel, H. et al., "Time–Dependent Electron Emission From Ferroelectrics by External Pulsed Electric Fields," Journal of Applied Physics, American Institute of Physics, New York, US vol. 69, No. 2, Jan. 15, 1991, pp. 975–982.

Kanemaru, Seigou, "Featuring: All About Flat Displays 2000, Leading Technological Trend of FEDs," Electronic Engineering, Nikkan Kogyo Shimbun, Ltd., Jul. 2000, pp. 38–41 (with partial translation).

* cited by examiner

ELECTRON-EMITTING ELEMENT AND FIELD EMISSION DISPLAY USING THE SAME

CROSS REFERENCE TO RELATED APPLICATIONS

This application is a continuation-in-part of U.S. application Ser. No. 10/206,409 filed Jul. 26, 2002, which is a continuation-in-part of U.S. application Ser. No. 10/027,232, filed Dec. 20, 2001, and also claims the benefit of Japanese Application 2000-390,299 filed Dec. 22, 2000, Japanese Application 2002-049,754 filed Feb. 26, 2002 and Japanese Application 2002-183,481 filed Jun. 24, 2002, the entireties of which are incorporated herein by reference.

TECHNICAL FIELD

The present invention relates to an electron-emitting element and a field emission display using the same.

BACKGROUND OF THE INVENTION

An electron-emitting element has a driving electrode and an earth electrode, and is used in various applications such as a field emission display (FED) and back light (for example, refer to Patent Literatures 1 to 5 and Non-Patent Literatures 1 to 3). In case of an FED, a plurality of electron-emitting elements are two dimensionally arranged and a plurality of phosphors opposing these electron-emitting elements are arranged at a certain space to each other.

However, since conventional electron-emitting elements are not good in straight advancing ability, namely, in the degree of the straight advancement of electron emitted from the electron-emitting element to specified objects (phosphors for example), and in order to hold a desired current density by emitted electrons, it is necessary to apply a comparatively high voltage to the electron-emitting element.

[Patent Literature 1] H01-311533 A (page 3, FIG. 1);
[Patent Literature 2] H07-147131 A (page 3, FIGS. 8 and 9);
[Patent Literature 3] 2000-285801 A (page 5, FIG. 3);
[Patent Literature 4] S46-20944 B (page 1, FIG. 2);
[Patent Literature 5] S44-26125 B (page 1, FIG. 2);
[Non-Patent Literature 1] Yasuoka, Ishii, Electron emission source using the ferroelectric ceramic cathode, J. Appl. Phys., Vol. 68, No. 5, p.546–550 (1999);
[Non-Patent Literature 2] V. F. Puchkarev, G. A. Mesyats, On the mechanism of emission from the ferroelectric ceramic cathode, J. Appl. Phys., Vol.78, No.9 November 1995, p.5633–5637; and
[Non-Patent Literature 3] H.Riege, Electron emission ferroelectrics—a review, Nucl. Instr. And Meth. A340, p.80–89 (1994);

In the case of using a conventional electron-emitting element in an FED, since straight advancing ability of the conventional electron-emitting element is not good, the crosstalk is relatively large, namely, there is a high probability that an emitted electron strikes a phosphor adjacent to the target phosphor. As a result, it is difficult to narrow the pitch between the phosphors and it is necessary to provide a grid in order to prevent an electron from hitting an adjacent phosphor.

It is an object of the present invention is to provide an electron-emitting element having a good straight advancing ability of emitted electrons and a field emission display using the same.

It is another object of the present invention is to provide an electron-emitting element realizing an electron emission with a high current density at a comparatively low vacuum and a remarkably low driving voltage and a field emission display using the same.

SUMMARY OF THE INVENTION

According to one embodiment of the present invention, an electron-emitting element is provided, comprising an electric field applying portion composed of a dielectric, a first electrode formed on one surface of this electric field applying portion, and a second electrode formed on the one surface of the electric field applying portion and forming a slit in cooperation with the first electrode.

According to the present invention, electrons are emitted from the electric field applying portion by applying a pulse voltage to the first or second electrode. By using a dielectric material for the electric field applying portion, it is possible to obtain a good straight advancing ability that cannot be achieved by conventional electron-emitting elements. As a result, the voltage applied to the electron-emitting element that is needed to hold a desired current density is remarkably lower than that of the conventional electron-emitting element, and the energy consumption is greatly reduced. Since the first and second electrodes can be formed on the electric field applying portion by means of a thick film printing method, the electron-emitting element according to the present invention is preferable from the viewpoint of durability and cost reduction.

In order to further reduce the voltage applied to the electron-emitting element even more, it is preferable to apply a conductive coating portion to the first and second electrodes and the slit. In this case, by applying the conductive coating portion, there is a remarkable reduction in the probability of damaging the first and second electrodes by collisions between electrons and ions or by the generation of heat.

More preferably, the electron-emitting element further comprises a first conductive coating portion provided on the first electrode and a second conductive coating portion provided on the second electrode. A non-contact condition is provided between the first conductive coating portion and the second conductive coating portion.

In this case, it is not necessary to provide a capacitor for cutting off a direct current because there is no resistor in an equivalent position between the first electrode and the second electrode, and thus it is possible to reduce a voltage to be applied to the electron-emitting element because it is not necessary to drive the electron-emitting element with a high voltage. In this case, also, by applying the first and the second conductive coating portions, there is a remarkable reduction in the probability of damaging the first and second electrodes by collisions between electrons and ions or by the generation of heat.

A portion with a high resistance may be provided on the slit, the high resistance portion having a higher resistance than those of the first and the second conducting coating portions and being in contact with the first and the second conducting coating portions electrically. In this case, the portion with a high resistance has a higher voltage than those of the first and the second conductive coating portions when applying the voltage to the electron-emitting element, and thus the degree of the concentration of the electric field in the portion with a high resistance, or the slit, is improved. As a result, it is possible to emit electrons at a lower applied voltage compared with the case of having no portion with a high resistance, reduce the power consumption of the electron-emitting element and achieve a cost reduction of the electron-emitting element because of the miniaturization of the circuit of the electron-emitting element and by omitting parts for high voltage from the electron-emitting element.

In order to perform a certain electron emission, it is preferable to further include a third electrode arranged at a certain space to the first and second electrodes, and to make the space between the first and second electrodes and the third electrode vacuum.

According to another embodiment of the present invention, an electron-emitting element is provided comprising an electric field applying portion comprising at least one of a piezoelectric material, an electrostrictive material and an antiferroelectric material, a first electrode formed on one surface of this electric field applying portion and a second electrode formed on the one surface of the electric field applying portion and forming a slit in cooperation with the first electrode.

According to this embodiment of the present invention, the electric field applying portion also acts as an actuator and may be bent and displaced when a pulse voltage is applied to the first or second electrodes. As a result, the straight advancing ability of the electron-emitting element is improved further.

In order to further reduce the voltage applied to the electron-emitting element even more, it is preferable to apply a conductive coating portion to the first and second electrodes and the slit. In this case, by applying the conductive coating portion, there is a remarkable reduction in the probability of damaging the first and second electrodes by collisions between electrons and ions or by the generation of heat.

More preferably, the electron-emitting element further comprises a first conductive coating portion provided on the first electrode and a second conductive coating portion provided on the second electrode. A non-contact condition is provided between the first conductive coating portion and the second conductive coating portion. In this case, it is not necessary to provide a capacitor for cutting off a direct current because there is no resistor in an equivalent position between the first electrode and the second electrode, and thus it is possible to reduce a voltage to be applied to the electron-emitting element because it is not necessary to drive the electron-emitting element with a high voltage. In this case, also, by applying of the first and the second conductive coating portions, there is a remarkable reduction in the probability of damaging the first and second electrodes by collisions between electrons and ions or by the generation of heat.

A portion with a high resistance may be provided on the slit, the high resistance portion having a higher resistance than those of the first and the second conducting coating portions and being in contact with the first and the second conducting coating portions electrically. In this case, the portion with a high resistance has a higher voltage than those of the first and the second conductive coating portions when applying the voltage to the electron-emitting element, and thus the degree of the concentration of the electric field in the portion with a high resistance, or the slit is improved. As a result, it is possible to emit electrons at a lower applied voltage compared with the case of having no portion with a high resistance, reduce the power consumption of the electron-emitting element and achieve a cost reduction of the electron-emitting element because of the miniaturization of the circuit of the electron-emitting element and by omitting parts for high voltage from the electron-emitting element.

In this case, also, in order to perform a certain electron emission, it is preferable to further comprise a third electrode being arranged at a certain space to the first and second electrodes and to make the space between the first and second electrodes and the third electrode a vacuum. At this time, the electric field applying portion also acts as the actuator, and makes it possible to control the amount of emitted electrons by the displacement motion of the electric field applying portion.

Preferably, the electron-emitting element further includes a voltage source for applying a direct offset voltage to the third electrode, and a resistor arranged in series between the voltage source and the third electrode. Thereby, a desired current density can be easily achieved, and short-circuits between the third electrode and the first and second electrodes is prevented.

For example, a pulse voltage is applied to the first electrode, and a direct offset voltage is applied to the second electrode.

Preferably, the electron-emitting element further includes a capacitor arranged in series between the first electrode and a voltage signal source. Thereby, a voltage can be applied between the first electrode and the second electrode only until the capacitor is charged up, and as a result, breakage caused by a short-circuit between the first and second electrodes is prevented.

In the case of further including a fourth electrode formed on the other surface of the electric field applying portion and opposite to the first electrode, since the electric field applying portion between the first electrode and the third electrode acts as a capacitor, breakage caused by a short-circuit between the first and second electrodes is prevented. In this case, for example, a pulse voltage is applied to the fourth electrode and a direct offset voltage is applied to the second electrode.

It may further include a resistor arranged in series between the second electrode and the direct offset voltage source. In this case, the current that flows from the first electrode discharging to the second electrode is suppressed by the resistor, and breakage caused by a short-circuit between the first and second electrodes is prevented.

In order to achieve a sharp reduction of the voltage applied, it is preferable that the relative dielectric constant of the electric field applying portion is not less than 1000 and/or that the width of the slit is not more than 500 $\mu$m.

In order to perform a certain electron emission, it is preferable that at least one of the first and second electrodes has an angular part with an acute angle and/or that the first electrode and the second electrode have carbon nanotubes, in other words, particles or a flocculation body of particles which include a carbon material having a six-fold-ring structure.

According to another embodiment of the present invention, a field emission display is provided, comprising a plurality of electron-emitting elements arranged in two dimensions and a plurality of phosphors being arranged at a certain space to each of these electron-emitting elements. Each of the electron-emitting elements includes an electric field applying portion composed of a dielectric a first electrode formed on one surface of this electric field applying portion and a second electrode formed on the one surface of the electric field applying portion and forming a slit in cooperation with the first electrode.

Since the field emission display according to this embodiment of the present invention is excellent in the straight advancing ability of the electron-emitting element, it experiences a reduced amount of crosstalk compared with a display comprising conventional electron-emitting elements, the pitch between phosphors can be narrower, and it is not necessary to provide a grid in order to prevent electrons from striking phosphors adjacent to the target phosphors. As a result, the field emission display according to the present invention is preferable from the viewpoint of improving resolution, downsizing (e.g., miniaturization) and reducing the costs of the display device. Since the emission of electrons can be performed even when the degree of vacuum inside a field emission display is comparatively low, it is still possible to emit electrons even when the degree of vacuum inside the display is lowered by a phosphor excitation and the like. Since conventional field emission displays need to hold a comparatively large vacuum space as a margin for maintaining the emission of electrons, it has been difficult to make a conventionally-equipped thin-sized display. On the other hand, since the present invention does not need to hold a large vacuum space in advance in order to keep the emission of electrons against drop of the degree of vacuum, it is possible to make the display according to the present invention thin-sized.

In order to further reduce the voltage applied to the electron-emitting element even more, it is preferable to apply a conductive coating portion to the first and second electrodes and the slit. In this case, by applying the conductive coating portion, there is a remarkable reduction in the probability of damaging the first and second electrodes by collisions between electrons and ions or by the generation of heat.

More preferably, the electron-emitting element further comprises a first conductive coating portion provided on the first electrode and a second conductive coating portion provided on the second electrode. A non-contact condition is provided between the first conductive coating portion and the second conductive coating portion. In this case, it is not necessary to provide a capacitor for cutting off a direct current because there is no resistor in an equivalent position between the first electrode and the second electrode, and thus it is possible to reduce a voltage to be applied to the electron-emitting element because it is not necessary to drive the electron-emitting element with a high voltage. In this case, also, by applying the first and the second conductive coating portions, there is a remarkable reduction in the probability of damaging the first and second electrodes by collisions between electrons and ions or by the generation of heat.

A portion with a high resistance may be provided on the slit, the high resistance portion having a higher resistance than those of the first and the second conducting coating portions and being in contact with the first and the second conducting coating portions electrically. In this case, the portion with a high resistance has a higher voltage than those of the first and the second conductive coating portions when applying the voltage to the electron-emitting element, and thus the degree of the concentration of the electric field in the portion with a high resistance, or the slit is improved. As a result, it is possible to emit electrons at a lower applied voltage compared with the case of having no portion with a high resistance, reduce the power consumption of the electron-emitting element and achieve a cost reduction for the electron-emitting element because of the miniaturization of the circuit of the electron-emitting element and by omitting parts for high voltage from the electron-emitting element.

In order to perform a certain electron emission, it is preferable to further include a third electrode arranged at a certain space to the first and second electrodes and make the space between the first and second electrodes and the third electrode vacuum.

According to another embodiment of the present invention, a field emission display is provided, comprising a plurality of electron-emitting elements arranged in two dimensions and a plurality of phosphors arranged at a certain space to each of these electron-emitting elements. Each of the electron-emitting elements includes an electric field applying portion composed of at least one of a dielectric material, an electrostrictive material and an antiferroelectric material, a first electrode formed on one surface of this electric field applying portion and a second electrode formed on the one surface of the electric field applying portion and forming a slit in cooperation with the first electrode.

Since the field emission display according to the present invention is excellent in the straight advancing ability of the electron-emitting element, it is more preferable from the viewpoint of miniaturization and cost reduction for a display device.

In order to further reduce the voltage applied to the electron-emitting element even more, it is preferable to apply a conductive coating portion to the first and second electrodes and the slit. In this case, by the application of the conductive coating portion, there is a remarkable reduction in the probability of damaging the first and second electrodes by collisions between electrons and ions or by the generation of heat.

More preferably, the electron-emitting element further comprises a first conductive coating portion provided on the first electrode and a second conductive coating portion provided on the second electrode. A non-contact condition is provided between the first conductive coating portion and the second conductive coating portion. In this case, it is not necessary to provide a capacitor for cutting off a direct current because there is no resistor in an equivalent position between the first electrode and the second electrode, and thus it is possible to reduce a voltage to be applied to the electron-emitting element because it is not necessary to drive the electron-emitting element with a high voltage. In this case, also, by the application of the first and the second conductive coating portions, there is a remarkable reduction in the probability of damaging the first and second electrodes by collisions between electrons and ions or by the generation of heat.

A portion with a high resistance may be provided on the slit, the high resistance portion having a higher resistance than those of the first and the second conducting coating portions and being in contact with the first and the second conducting coating portions electrically. In this case, the portion with a high resistance has a higher voltage than those of the first and the second conductive coating portions when applying the voltage to the electron-emitting element, and thus the degree of the concentration of the electric field in the portion with a high resistance, or the slit is improved. As a result, it is possible to emit electrons at a lower applied voltage compared with the case of having no portion with a high resistance, reduce the power consumption of the electron-emitting element and reduce the cost by miniaturizing the circuit of the electron-emitting element and omitting parts for high voltage from the electron-emitting element.

In this case, also, in order to perform a certain electron emission, it is preferable to further include a third electrode arranged at a certain space to the first and second electrodes and make the space between the first and second electrodes and the third electrode vacuum. At this time, the electric field applying portion also acts as an actuator and can control the amount of emitted electrons by the displacement motion of the electric field applying portion.

Preferably, the electron-emitting element further includes a voltage source for applying a direct offset voltage to the third electrode and a resistor arranged in series between this voltage source and the third electrode. Thereby, the desired current density, namely, the desired amount of luminescence of phosphors can be easily achieved, and a short-circuit between the third electrode and the first and second electrodes is prevented.

For example, a pulse voltage is applied to the first electrode and a direct offset voltage is applied to the second electrode.

Preferably, the electron-emitting element further includes a capacitor arranged in series between the first electrode and the voltage signal source. Thereby, breakage caused by a short-circuit between the first and second electrodes is prevented.

Also, when the electron-emitting element further includes a fourth electrode formed on the other surface of the electric field applying portion and facing the first electrode, breakage caused by a short-circuit between the first and second electrodes. In this case, for example, a pulse voltage is applied to the fourth electrode and a direct offset voltage is applied to the second electrode.

In the case where the electron-emitting element further includes a resistor arranged in series between the second electrode and the direct offset voltage source, breakage caused by a short-circuit between the first and second electrodes is prevented.

In order to achieve a sharp reduction of the voltage to be applied, it is preferable that the relative dielectric constant of the electric field applying portion is not less than 1000 and/or that the width of the slit is not more than 500 $\mu$m.

In order to perform a certain electron emission, it is preferable that at least one of the first and second electrodes has an angular part with an acute angle and/or that the first and second electrodes have carbon nanotubes.

A field emission display according to the present invention further comprises a substrate having a plurality of electron-emitting elements arranged in two-dimensions and formed into one body with it.

DETAILED DESCRIPTION OF THE INVENTION

Figure 1A:
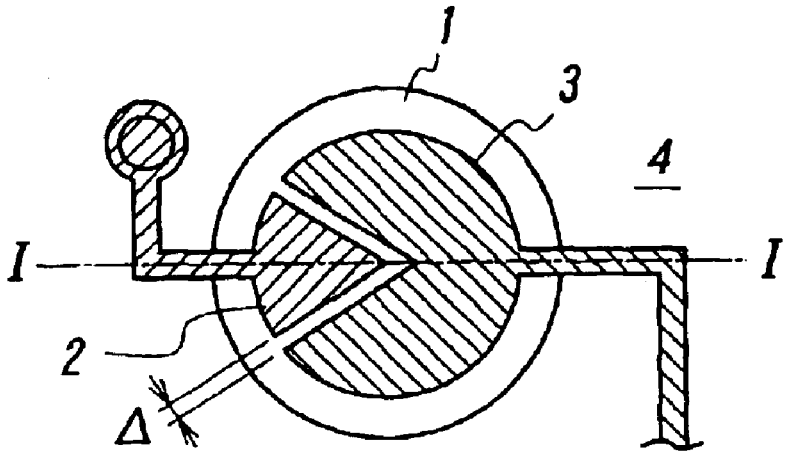
FIG. 1 is a diagram showing a first embodiment of the electron-emitting element according to the present invention.
Figure 1B:
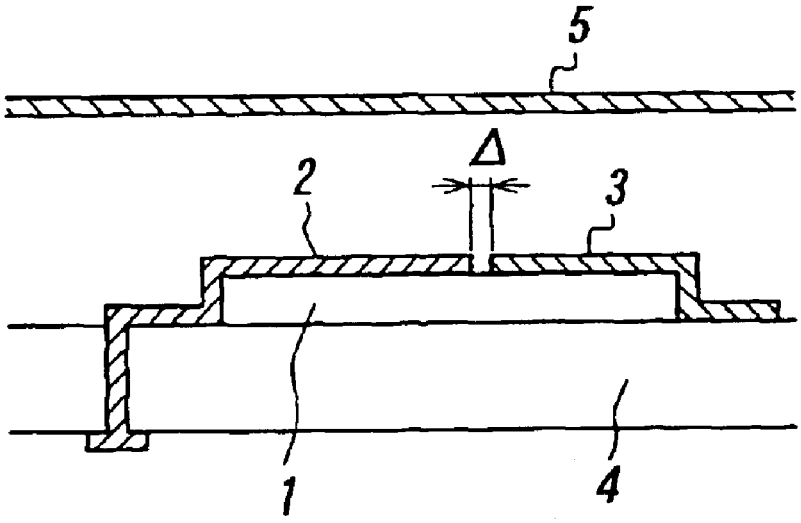

Embodiments of the electron-emitting element and the field emission display using the same will be explained with reference to the drawings. FIG. 1A is a top view of a first embodiment of the electron-emitting element according to the present invention, and FIG. 1B is a sectional view taken along line I—I. This electron-emitting element has an electric field applying portion 1 composed of a dielectric, a driving electrode 2 as a first electrode formed on one surface of the electric field applying portion 1 and a common electrode 3 as a second electrode formed on the same surface as the driving electrode 2 and forming a slit in cooperation with the driving electrode 2, and the electron-emitting element is formed on a substrate 4. Preferably, in order to capture emitted electrons well, this electron-emitting element further has an electron capturing electrode 5 as a third electrode arranged at a certain space to the one surface of the electric field applying portion 1, and the space therebetween is maintained in a vacuum state. And, in order to prevent breakage caused by a short-circuit between the driving electrode 2 and the common electrode 3, a capacitor (not illustrated) is arranged in series between the driving electrode 2 and a not shown voltage signal source and/or a not shown resistor is arranged in series between the common electrode 3 and a not shown direct offset voltage source.

A dielectric having a comparatively high relative dielectric constant, for example, not less than 1000, is preferably adopted as a dielectric of the electric field applying portion 1. Example of such a dielectric include ceramics containing barium titanate, lead zirconate, magnesium lead niobate, nickel lead niobate, zinc lead niobate, manganese lead niobate, magnesium lead tantalate, nickel lead tantalate, antimony lead stannate, lead titanate, barium titanate, magnesium lead tungstate, cobalt lead niobate or the like, or an optional combination of these, and ceramics containing these compounds of 50 wt % or more as its main ingredients, and furthermore ceramics having an oxide of lanthanum, calcium, strontium, molybdenum, tungsten, barium, niobium, zinc, manganese, nickel or the like, or some combination of these or other compounds and the like properly added to the ceramic. For example, in the case of a two-component system nPMN-mPT (n and m are represented in molar ratio) of magnesium lead niobate (PMN) and lead titanate (PT), when the molar ratio of PMN is made large, its Curie point is lowered and its relative dielectric constant at a room temperature can be made large. Particularly, the condition of "n=0.85 to 1.0, m=1.0−n" makes preferably a relative dielectric constant of 3000 or more. For example, the condition of "n=0.91, m=0.09" gives a relative dielectric constant of 15,000 at a room temperature and the condition of "n=0.95, m=0.05" gives a relative dielectric constant of 20,000 at a room temperature. Next, in a three-component system of magnesium lead niobate (PMN), lead titanate (PT) and lead zirconate (PZ), it is preferable for the purpose of making the relative dielectric constant to make the composition of the three-component system close to the composition of the vicinity of the morphotropic phase boundary (MPB) between a tetragonal system and a pseudo-tetragonal system or between a tetragonal system and a rhombohedral system as a manner other than making the molar ratio of PMN be large. Particularly preferably, for example, the condition of "PMN: PT : PZ=0.375: 0.375 : 0.25" provides the relative dielectric constant of 5,500 and the condition of "PMN: PT: PZ=0.5: 0.375: 0.125" provides the relative dielectric constant of 4,500. Further, it is preferable to improve the dielectric constant by mixing these dielectrics with such metal as platinum within a range where the insulation ability is secured. In this case, for example, the dielectric is mixed with platinum of 20% in weight.

In this embodiment, the driving electrode 2 has an angular part with an acute angle. A pulse voltage is applied to the driving electrode 2 from a not shown power source, and electrons are emitted mainly from the angular part. In order to perform a certain electron emission, the width Δ of the slit between the driving electrode 2 and the common electrode 3 is preferably not more than 500 μm. The driving electrode 2 is composed of a conductor having resistance to a high-temperature oxidizing atmosphere, for example, a single metal, an alloy, or a mixture of an insulating ceramic and a single metal, a mixture of an insulating ceramic and an alloy or the like, and is preferably composed of a high-melting point precious metal such as platinum, palladium, rhodium, molybdenum or the like, or a material having such an alloy as silver-palladium, silver-platinum, platinum-palladium or the like as its main ingredient, or a cermet material of platinum and a ceramic. More preferably, it is composed of only platinum or a material having a platinum-based alloy as its main ingredient. And as a material for electrodes, carbon-based or graphite-based materials, for example, a diamond thin film, a diamond-like carbon and a carbon nanotube are also preferably used. An amount of a ceramic material added to the electrode material is preferably 5 to 30 vol %.

The driving electrode 2 can be composed using the above-mentioned materials by ordinary film forming methods. For example, various thick film forming methods can be used, such as screen printing, spraying, coating, dipping, application, electrophoresing and the like, or various thin film forming methods can be used such as sputtering, ion beaming, vacuum deposition, ion plating, CVD, plating and the like. The driving electrode is preferably made by these thick film forming methods.

In case of forming the driving electrode 2 by means of a thick film forming method, the thickness of driving electrode 2 is generally not more than 20 μm, and preferably not more than 5 μm.

A direct offset voltage is applied to the common electrode 3, and is led by the wiring passing through an not shown through hole from the reverse side of the substrate 4.

The common electrode 3 is formed by means of a material and method similar to those for the driving electrode 2, and preferably by means of the above-mentioned thick film forming methods. The width of the common electrode 3 also is generally not more than 20 μm and preferably not more than 5 μm.

Preferably, the substrate 4 is composed of an electrically insulating material in order to electrically separate a wire electrically connected to the driving electrode 2 and a wire electrically connected to the common electrode 3 from each other.

Therefore, the substrate 4 can be composed of a material like an enameled material obtained by coating the surface of a high heat-resistant metal with a ceramic material such as glass and the like, and is optimally composed of a ceramic.

As a ceramic material to form the substrate 4, for example, stabilized zirconium oxide, aluminum oxide, magnesium oxide, titanium oxide, spinel, mullite, aluminum nitride, silicon nitride, glass, a mixture of these and the like can be used. Among them, aluminum oxide and stabilized zirconium oxide are particularly preferable from the viewpoint of strength and rigidity. Stabilized zirconium oxide is particularly preferable in that it is comparatively high in mechanical strength, comparatively high in toughness and comparatively small in chemical reaction to the driving electrode 2 and the common electrode 3. The stabilized zirconium oxide includes stabilized zirconium oxide and partially stabilized zirconium oxide. Since the stabilized zirconium oxide takes a crystal structure such as a cubic system, it undergoes no phase transition.

On the other hand, zirconium oxide undergoes a phase transition between a monoclinic system and a tetragonal system and has a crack generated at the time of such a phase transition. Stabilized zirconium oxide contains a stabilizer such as calcium oxide, magnesium oxide, yttrium oxide, scandium oxide, ytterbium oxide, cerium oxide, rare metal oxide and the like of 1 to 30 mol %. It is preferable for the stabilizer to contain yttrium oxide in order to improve the mechanical strength of substrate 4. In this case, it preferably contains yttrium in 1.5 to 6 mol %, more preferably 2 to 4 mol %, and preferably further contains aluminum oxide in 1 to 5 mol %.

And its crystal phase can be made into a mixed phase of "cubic system+monoclinic system," a mixed phase of "tetragonal system+monoclinic system," a mixed phase of "cubic system+tetragonal system+monoclinic system," or the like. Among these, a crystal phase having a tetragonal system or a mixed phase of "tetragonal system+cubic system" as its main crystal phase is optimal from the viewpoint of strength, toughness and durability.

In case of composing the substrate 4 of ceramic, comparatively many crystal particles form the substrate 4, and in order to improve the mechanical strength of the substrate 4, the average particle diameter of the crystal particles is preferably in a range of 0.05 to 2 μm, and more preferably in a range of 0.1 to 1 μm.

The electric field applying portion 1, the driving electrode 2 and the common electrode 3 can be formed into one body together with the substrate 4 by applying heat treatment to the substrate 4, namely, by firing the substrate 4 each time forming one of them respectively, or these electric field applying portion 1, the driving electrode 2 and the common electrode 3 are formed on the substrate 4 and thereafter are heat-treated, namely, are co-fired and thereby are formed into one body together with the substrate 4 at the same time.

Depending upon the method of forming the driving electrode 2 and common electrode 3, any heat treatment, namely, firing for unification may not be needed.

The heat treatment temperature, namely, a firing temperature for forming the electric field applying portion 1, the driving electrode 2 and the common electrode 3 into one body together with the substrate 4, includes a temperature range of generally 500 to 1,400° C., and preferably 1,000 to 1,400° C. In order to keep the composition of the electric field applying portion 1 stable at a high temperature in the case of heat treating the film-shaped voltage applying portion 1, it is preferable to perform heat treatment, namely, firing while controlling the vapor source and the atmosphere of the electric field applying portion 1, and it is preferable to adopt a technique of firing to prevent the surface of the electric field applying portion 1 from being exposed directly to the firing atmosphere by covering the electric field applying portion 1 with a proper member. In this case, a material similar to the substrate 4 is used as a covering member.

Figure 2A:
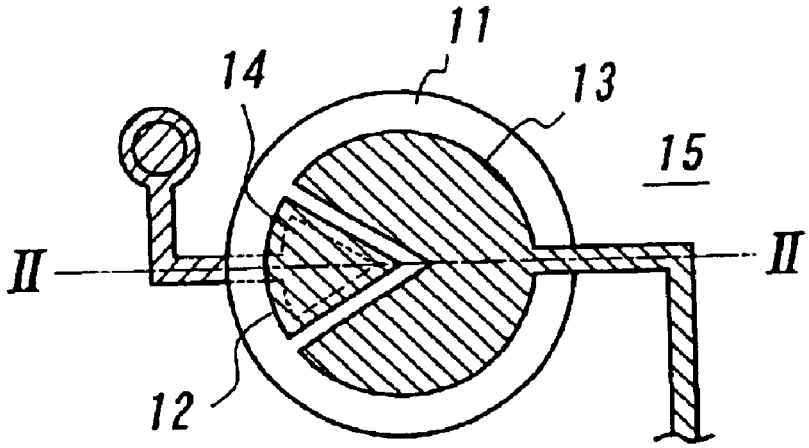
FIG. 2 is a diagram showing a second embodiment of the electron-emitting element according to the present invention.
Figure 2B:
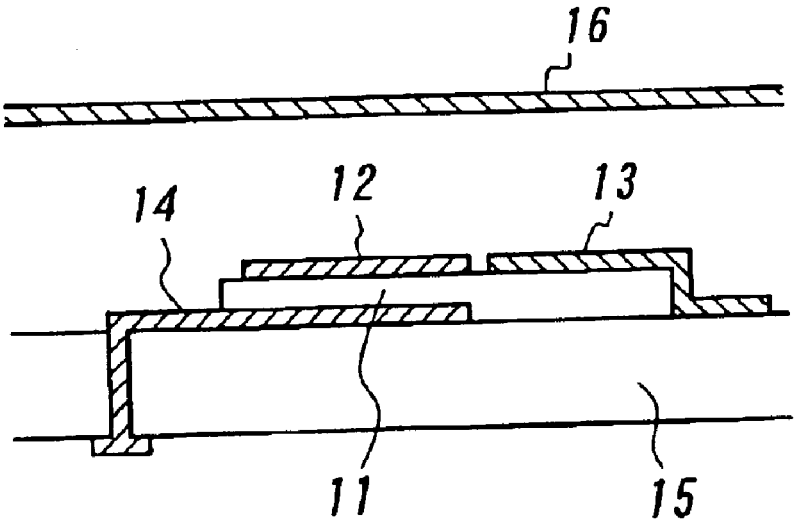

FIG. 2A is a top view of a second embodiment of the electron-emitting element according to the present invention, and FIG. 2B is a sectional view taken along line II—II. This electron-emitting element has an electric field applying portion 11, a driving electrode 12 and a common electrode 13 respectively corresponding to the electric field applying portion 1, the driving electrode 2 and the common electrode 3, and additionally to them, further has a driving terminal electrode 14 as a fourth electrode formed on the other surface of the electric field applying portion 11, and they are formed on a substrate 15. In this case, also, preferably in order to capture emitted electrons well, the electron-emitting element further has an electron capturing electrode 16 as a third electrode being arranged at a certain space to one surface of the electric field applying portion 11, and keeps the space therebetween in a vacuum state.

In this embodiment, since the electric field applying portion 11 between the driving electrode 12 and the driving terminal electrode 14 acts as a capacitor, it is not necessary to provide an additional capacitor in order to prevent breakage caused by short-circuit between the driving electrode 12 and the common electrode 13. In this case, a pulse voltage is applied to the driving terminal electrode 14 and a direct offset voltage is applied to the common electrode 13.

Figure 3A:
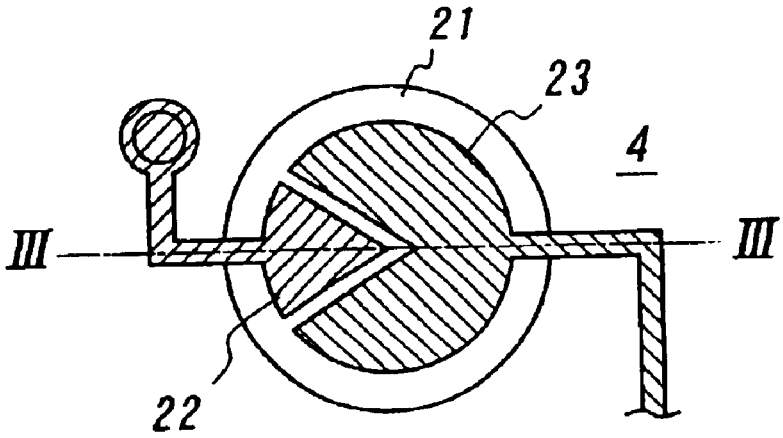
FIG. 3 is a diagram showing a third embodiment of the electron-emitting element according to the present invention.
Figure 3B:
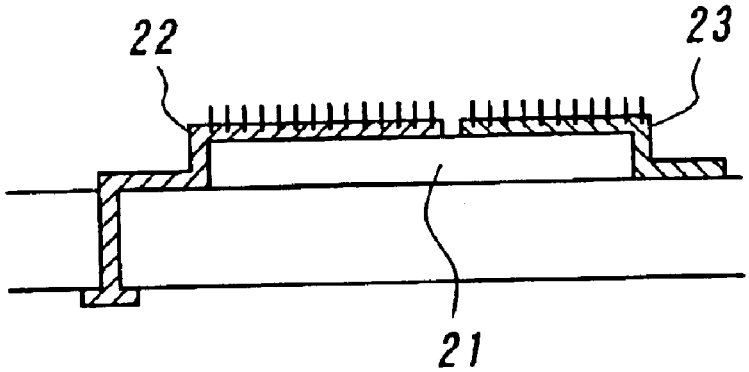

The driving terminal electrode 14 is also formed by means of a similar material and technique to those for the driving electrode 12 and the common electrode 13, and preferably formed by means of one of the above-mentioned thick film forming methods. The thickness of the driving terminal electrode 14 is also generally not more than 20 μm, and preferably not more than FIG. 3A is a top view of a third embodiment of the electron-emitting element according to the present invention, and FIG. 3B is a sectional view taken along line III—III. In this embodiment, similar to the first embodiment, a driving electrode 22 and a common electrode 23 are formed on one surface of an electric field applying portion 21, and a plurality of carbon nanotubes (CNT) are provided on the surfaces of the driving electrode 22 and common electrode 23, and thereby, it is easy to emit electrons from the top of the CNT when applying a pulse voltage to the driving electrode 22 and applying a direct offset voltage to the common electrode 23.

Figure 4A:
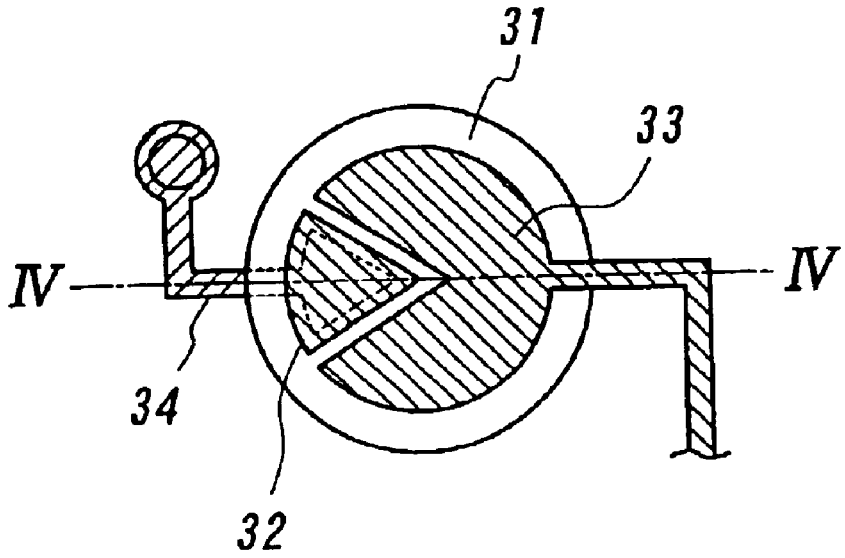
FIG. 4 is a diagram showing a fourth embodiment of the electron-emitting element according to the present invention.
Figure 4B:
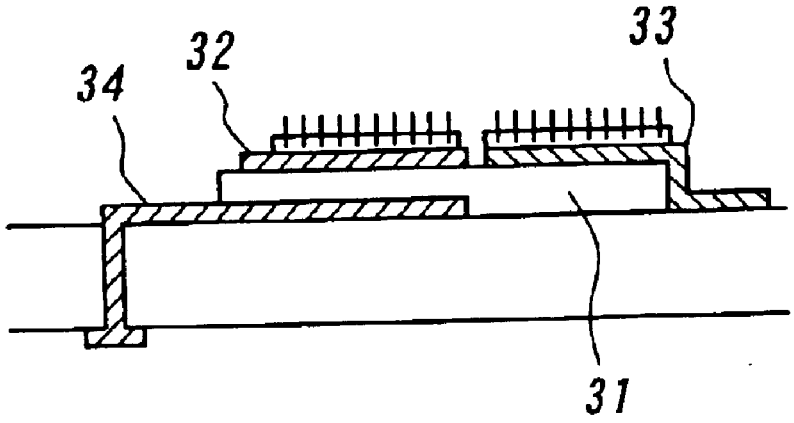

FIG. 4A is a top view of a fourth embodiment of the electron-emitting element according to the present invention, and FIG. 4B is a sectional view taken along line IV—IV. In this embodiment, similar to the second embodiment, a driving electrode 32 and a common electrode 33 are formed on one surface of an electric field applying portion 31, and a driving terminal electrode 34 is formed on the other surface of it, and a plurality of carbon nanotubes (CNT) are provided on the surfaces of these driving electrode 32 and common electrode 33, and thereby, it is easy to emit electrons from the top of the CNT when applying a pulse voltage to the driving electrode 32 and applying a direct offset voltage to the common electrode 33.

Figure 5A:
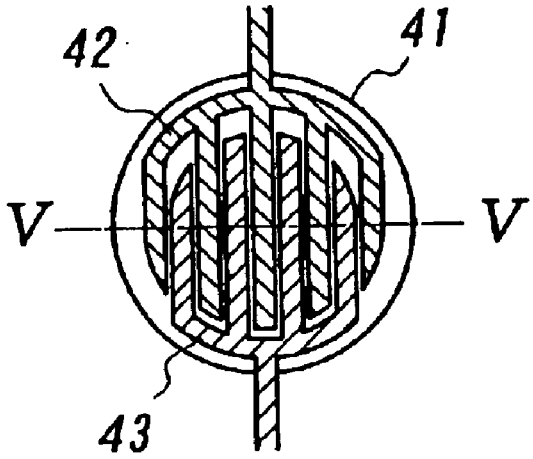
FIG. 5 is a diagram showing a fifth embodiment of the electron-emitting element according to the present invention.
Figure 5B:
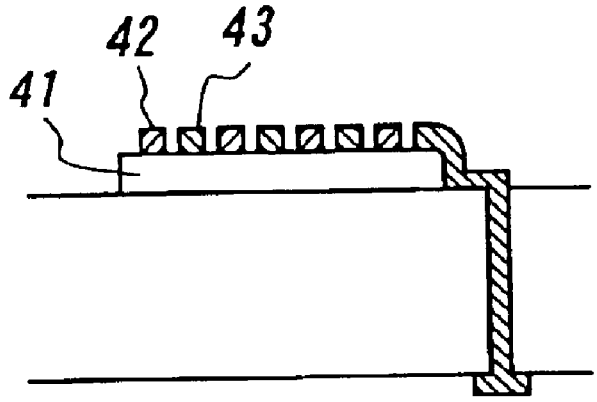

FIG. 5A is a top view of a fifth embodiment of the electron-emitting element according to the present invention, and FIG. 5B is a sectional view taken along line V—V. In this embodiment, a driving electrode 42 and a common electrode 43 which are in the shape of the teeth of a comb are formed on one surface of an electric field applying portion 41. In this case, it is easy to emit electrons from the angular parts of these driving electrode 42 and common electrode 43.

Figure 6A:
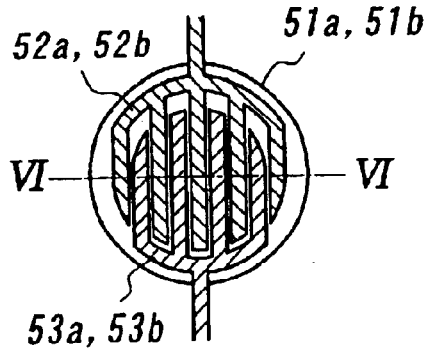
FIG. 6 is a diagram showing a sixth embodiment of the electron-emitting element according to the present invention.
Figure 6B:
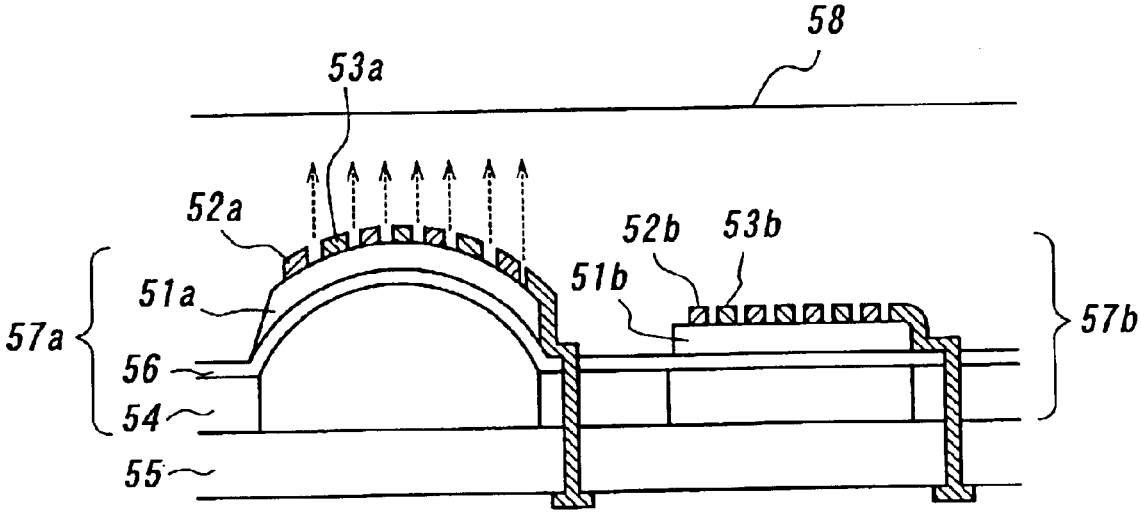

FIG. 6A is a top view of a sixth embodiment of the electron-emitting element according to the present invention, and FIG. 6B is a sectional view taken along line VI—VI. In this embodiment, the electron-emitting element has electric field applying portions 51*a*, 51*b* made of an antiferroelectric material, and driving electrodes 52*a*, 52*b* and common electrodes 53*a*, 53*b* which are in the shape of the teeth of a comb and are formed respectively on one-side surfaces of the electric field applying portions 51*a*, 51*b*.

The electron-emitting element is disposed on a sheet layer 56 provided through a spacer layer 54 on a substrate 55. Thereby, the electric field applying portions 51*a*, 51*b*, the driving electrodes 52*a*, 52*b*, the common electrodes 53*a*, 53*b*, the sheet layer 56 and the spacer layer 54 form actuators 57*a*, 57*b*, respectively.

As an antiferroelectric material of the electric field applying portions 51*a*, 51*b*, it is preferable to use a material having lead zirconate as its main ingredient, a material having a component consisting of lead zirconate and lead stannate as its main ingredient, a material obtained by adding lanthanum oxide to lead zirconate, or a material obtained by adding lead zirconate or lead niobate to a component consisting of lead zirconate and lead stannate. Particularly, in the case of driving the electron-emitting element at a low voltage, it is preferable to use an antiferroelectric material containing a component consisting of lead zirconate and lead stannate having the following composition:

$PB_{0.99}Nb_{0.02}[(Zr_xSn_{1-x})_{1-y}Ti_y]_{0.988}O_3$.

The antiferroelectric materials can also be porous, and in this case, it is preferable that the porosity is not more than 30%.

The electric field applying portions 51*a*, 51*b* are preferably formed by means of one of the above-mentioned thick film forming methods, and a screen printing method is particularly preferable because it provides a fine printing inexpensively. The thickness of the electric field applying portions 51*a*, 51*b* are preferably 50 μm or less, and more preferably 3 to 40 μm, in order to obtain a large displacement at a low operating voltage and the like.

By such a thick film forming technique, a film can be formed on the surface of the sheet layer 56 using a paste or slurry having as its main ingredient antiferroelectric ceramic particles having the average particle diameter of 0.01 to 7 μm, preferably 0.05 to 5 μm, and good element characteristics can be obtained.

An electrophoresis method can form a film in a high density under a high shape control, and has features as described in technical papers "DENKI KAGAKU (ELECTROCHEMISTRY) 53, No.1 (1985), pp.63–68 by Kazuo Anzai" and "First Study Meeting On Method For High Order Forming Of Ceramic By Electrophoresis, Collection of Papers (1998), pp. 5–6 and pp. 23–24." Therefore, it is preferable to properly select and use a technique from various techniques in consideration of required accuracy, reliability and the like.

The sheet layer 56 is relatively thin and has a structure that is subject to receive vibrations from an external stress. The sheet layer 56 is preferably composed of a high heat-resisting material to prevent the sheet layer 56 from deteriorating in quality at least when the electric field applying portions 51*a*, 51*b* are formed in the case of using a structure that directly supports the sheet layer 56 without using a material being comparatively low in heat resistance, such as an organic adhesive and the like, at the time of joining the driving terminal electrode directly to the sheet layer 56 as shown in FIGS. 2 and 4. In case of forming the sheet layer 56 from a ceramic, it is formed in a similar manner to the substrate 4 in FIG. 1.

The spacer layer 54 is preferably formed out of a ceramic, and it may be formed out of the same material as, or a different material from, the ceramic material forming the sheet layer 56. As such a ceramic, in the same manner as the ceramic material for forming the sheet layer 56, for example, stabilized zirconium oxide, aluminum oxide, magnesium oxide, titanium oxide, spinel, mullite, aluminum nitride, silicon nitride, glass, a mixture of these, and the like can be used.

Examples of ceramic materials that are different from ceramic materials forming the spacer layer 54, the substrate 55 and the sheet layer 56include a material having zirconium oxide as its main ingredient, a material having aluminum oxide as its main ingredient, a material having a mixture of these as its main ingredient and the like. Among these, a material having zirconium oxide as its main ingredient is particularly preferable. Clay or the like may be added as a sintering adjuvant, but it is necessary to adjust the composition of such an adjuvant so as not to contain excessively such an ingredient that is liable to form a glass, such as silicon oxide, boron oxide and the like. The reason is that these materials that are liable to form a glass are advantageous from the viewpoint of joining with the electric field applying portions 51*a*, 51*b*, but they accelerate the reaction with the electric field applying portions 51*a*, 51*b* and make it difficult for the electric field applying portions 51*a*, 51*b* to keep their specified composition. As a result, the element characteristics are deteriorated.

That is to say, it is preferable to limit the amount of silicon oxide and the like contained in the spacer layer 54, the substrate 55 and the sheet layer 56 to not more than 3% in weight, preferably not more than 1%. Here, an ingredient occupying at least 50% in weight is referred to as the main ingredient.

The spacer layer 54, the substrate 55 and the sheet layer 56 are preferably formed into a 3-layered laminate, and in this case, for example, simultaneous unification firing, joining the respective layers together using a glass or a resin to form one body or after-joining is performed. They can be also formed into a laminate having not less than four layers.

In the case of forming the electric field applying portions 51*a*, 51*b* out of an antiferroelectric material like this embodiment, they become flat like the electric field applying portion 51*b* in a state where no electric field is applied, while they are bent and displaced in a convex shape like the electric field applying portion 51*a* when an electric field is applied to them. Since the space between the electron-emitting element and the opposing electron capturing electrode 58 is made narrow by bending in such a convex shape, the straight advancing ability of electrons generated is more improved as shown by arrows. Therefore, it is possible to control the amount of emitted electrons to reach the electron capturing electrode 58 by means of this quantity of bending.

Figure 7A:
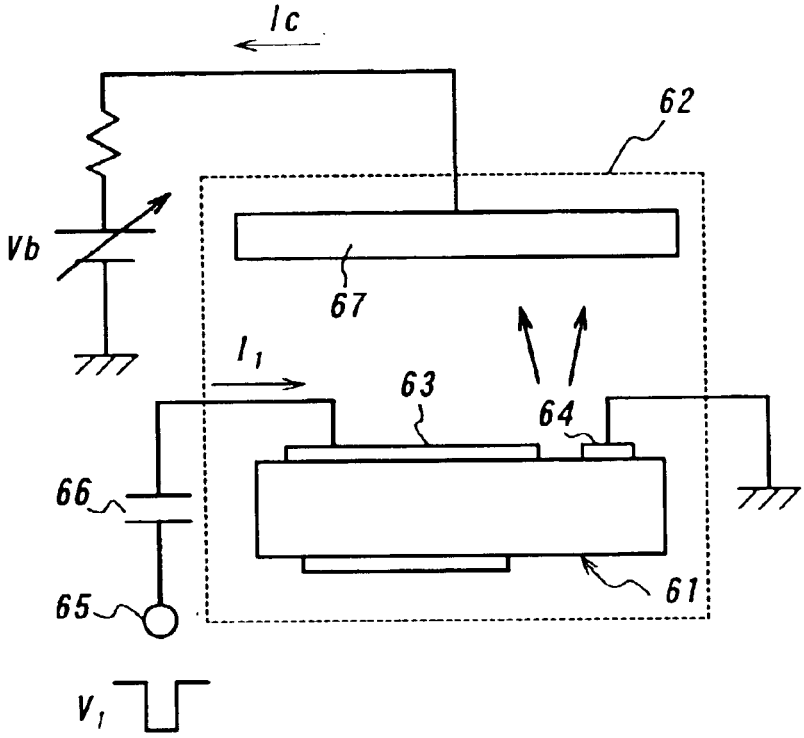
FIG. 7 is a diagram for explaining the operation of the electron-emitting element according to the present invention.

Next, the operation of the electron-emitting element according to the present invention is described. FIG. 7 is a diagram for explaining the operation of the electron-emitting element according to the present invention. In this case, a current control element 61 has a structure shown in FIG. 1, and the circumstance of the current control element 61 is kept in a vacuum state by a vacuum chamber 62. And a capacitor 66 is arranged in series between a driving electrode 63 and a common electrode 64 in order to prevent short-circuit between the driving electrode 63 and the common electrode 64. A bias voltage $V_b$ is applied to an electron capturing electrode 67 opposite to the driving electrode 63 and the common electrode 64.

Figure 7B:
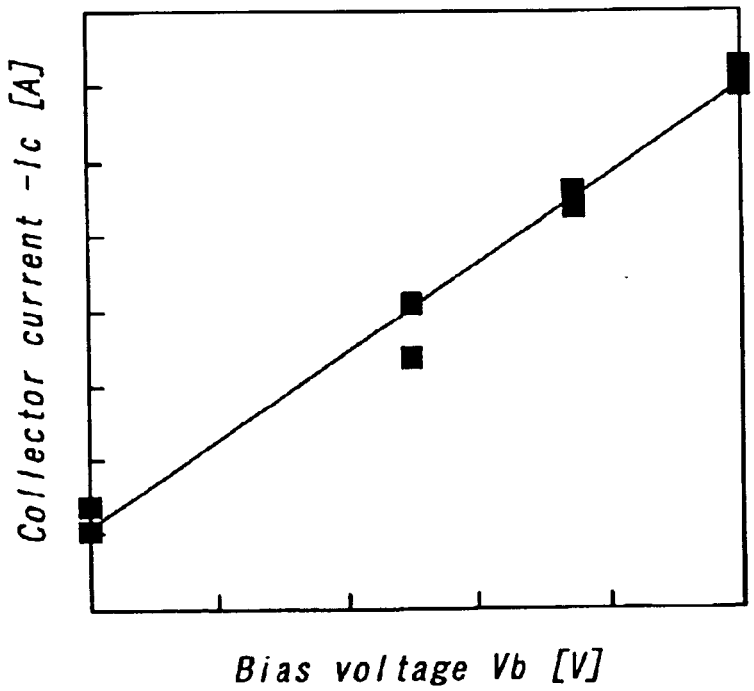

In the case where the voltage VI applied to a signal voltage source 65 is −400 V, the capacity of the capacitor 66 is 500 pF, the bias voltage is 0 V, the width of a slit formed by the driving electrode 63 and the common electrode 64 is 10 μm, and the degree of vacuum inside the vacuum chamber 62 is $1\times10^{-3}$ Pa, the current $I_1$ flowing through the driving electrode 63 is 2.0 A and the density of a collector current Ic taken from the electron capturing electrode 67 is 1.2 A/cm$^2$. As a result, according to an electron-emitting element of the present invention, a higher current density is obtained at a lower voltage and a lower degree of vacuum in comparison with a conventional electron-emitting element, and as a result an excellent straight advancing ability is displayed. As shown in FIG. 7B, the collector current Ic becomes larger as the bias voltage Vb becomes higher.

Figure 8A:
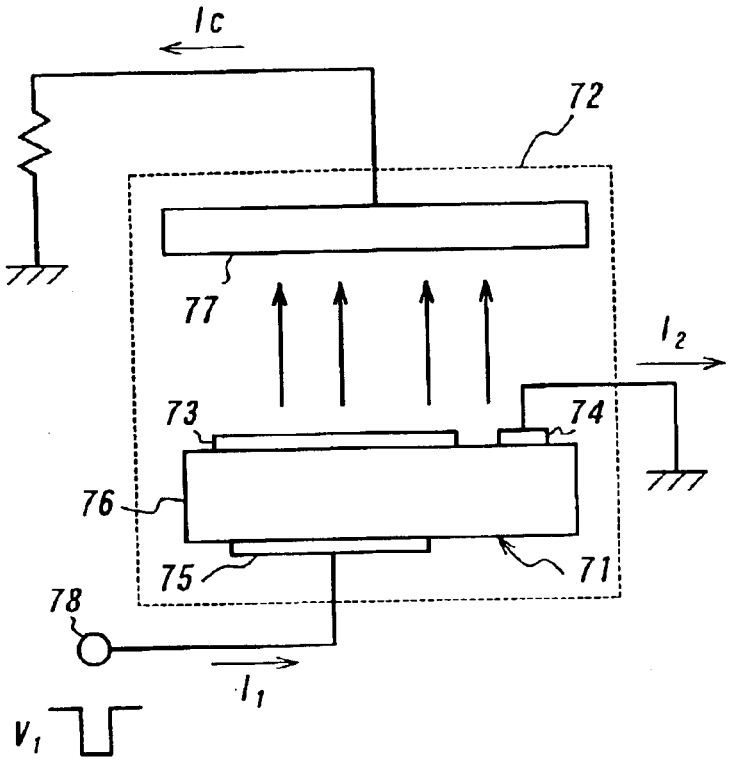
FIG. 8 is a diagram for explaining the operation of the other electron-emitting element according to the present invention.
Figure 8B:
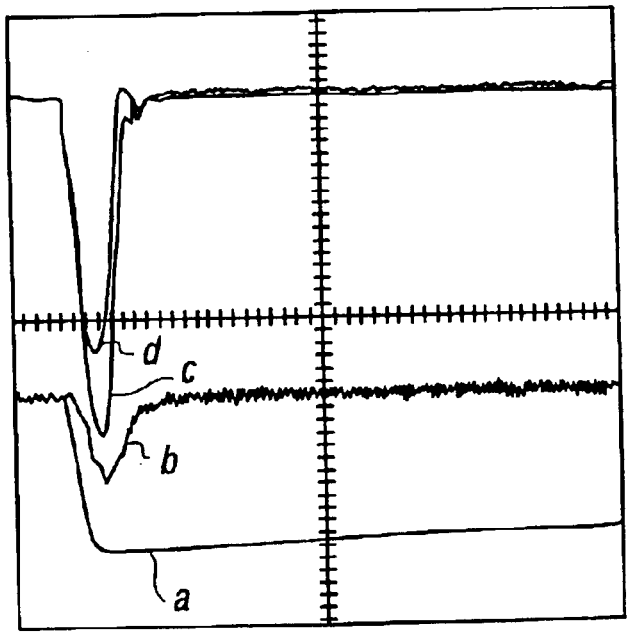

FIG. 8 is a diagram for explaining the operation of the other electron-emitting element according to the present invention. In this case, a current control element 71 has a structure shown in FIG. 2, and the circumstance of the current control element 71 is kept in a vacuum state by a vacuum chamber 72. And an electric field applying portion 76 between a driving electrode 73 and a driving terminal electrode 75 acts as a capacitor in order to prevent short-circuits between the driving electrode 73 and the common electrode 74. An electron capturing electrode 77 is opposite to the driving electrode 73 and the common electrode 74.

In the case where the voltage VI applied to a signal voltage source 78 is −400 V, the capacity of the electric field applying portion 76 acting as a capacitor is 530 pF, the width of a slit formed by the driving electrode 73 and the common electrode 74 is 10 $\mu$m, and the degree of vacuum inside the vacuum chamber 72 is $1\times10^{-3}$ Pa, the current $I_1$ flowing through the driving terminal electrode 75 is 2.0 A and the density of a collector current Ic taken from the electron capturing electrode 77 is 1.2 A/cm$^2$. As a result, according to another electron-emitting element of the present invention, a higher current density is obtained at a lower voltage and a lower degree of vacuum in comparison with a conventional electron-emitting element, and as a result an excellent straight advancing ability is displayed. The waveforms of the voltage $V_1$, and the currents Ic, $I_1$ and $I_2$ are respectively shown by curves a to d in FIG. 8B.

Figure 9:
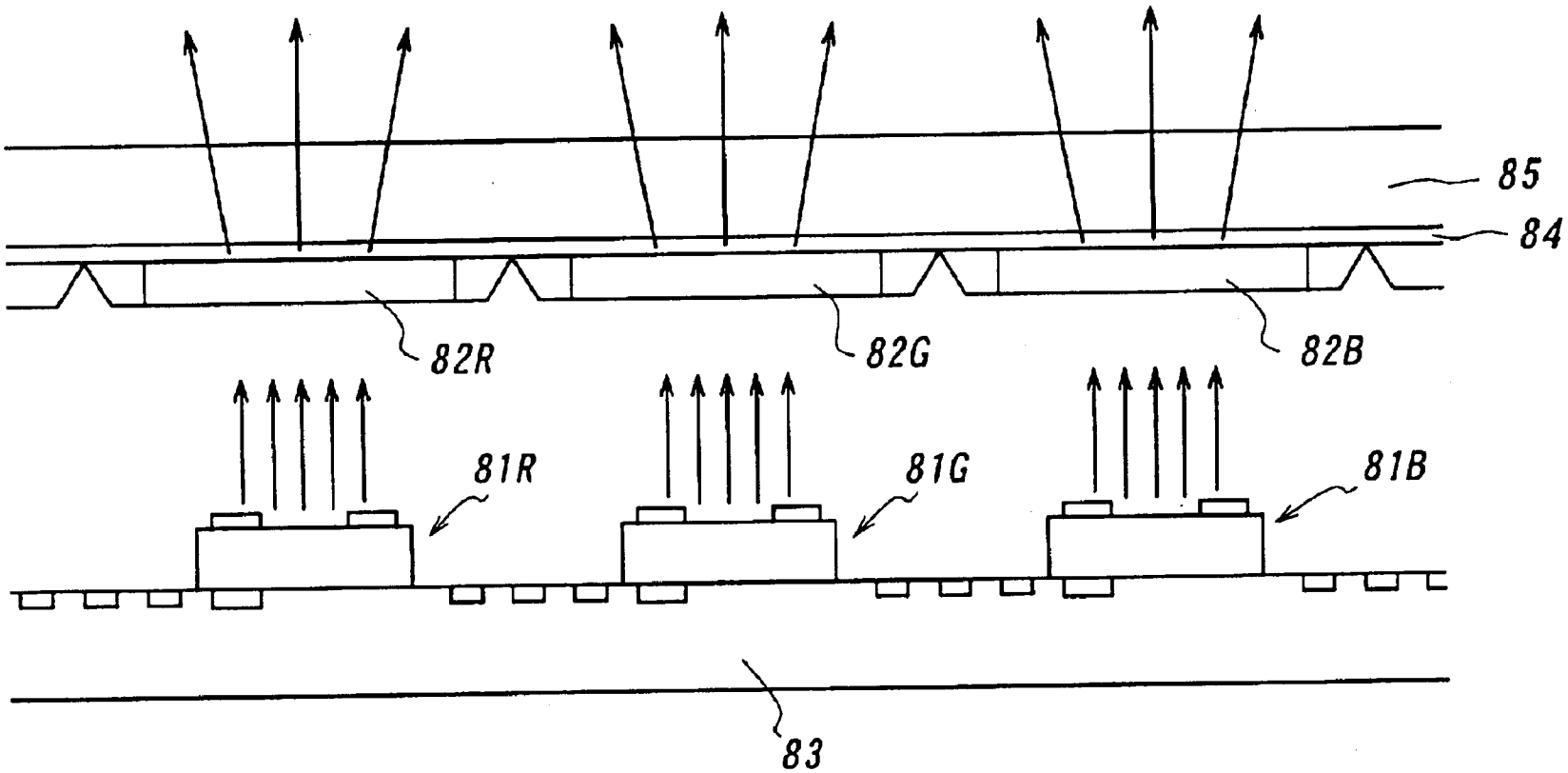
FIG. 9 is a diagram showing an embodiment of the FED according to the present invention.

FIG. 9 is a diagram showing an embodiment of a FED according to the present invention. This FED comprises a plurality of electron-emitting elements 81R, 81G and 81B arranged in two dimensions, and a red phosphor 82R, green phosphor 82G and blue phosphor 82B being arranged at a certain space to these electron-emitting elements 81R, 81G and 81B, respectively.

In this embodiment, the electron-emitting elements 81R, 81G and 81B are formed on a substrate 83, and the red phosphor 82R, green phosphor 82G and blue phosphor 82B are formed through the electron capturing electrode 84 on a glass substrate 85. The electron-emitting elements 81R, 81G and 81B each have a structure shown in FIG. 2, but may have any of the structures shown in FIGS. 1 and 3 to 6.

According to this embodiment, since the electron-emitting elements 81R, 81G and 81B are excellent in straight advancing ability, the crosstalk is smaller compared with a case of having conventional electron-emitting elements and the pitch between the phosphors 82R, 82G and 82B can be narrower, and it is not necessary to provide a grid in order to prevent electrons from striking on adjacent phosphors 82R, 82G and 82B. As a result, the FED of this embodiment is preferable from the viewpoint of downsizing and cost reduction. Since it can emit electrons even if the degree of vacuum is comparatively low, it is not necessary to leave a margin for a lowering of vacuum by making the vacuum space large in advance and thus restrictions against making the FED thin-sized are reduced.

Figure 10:
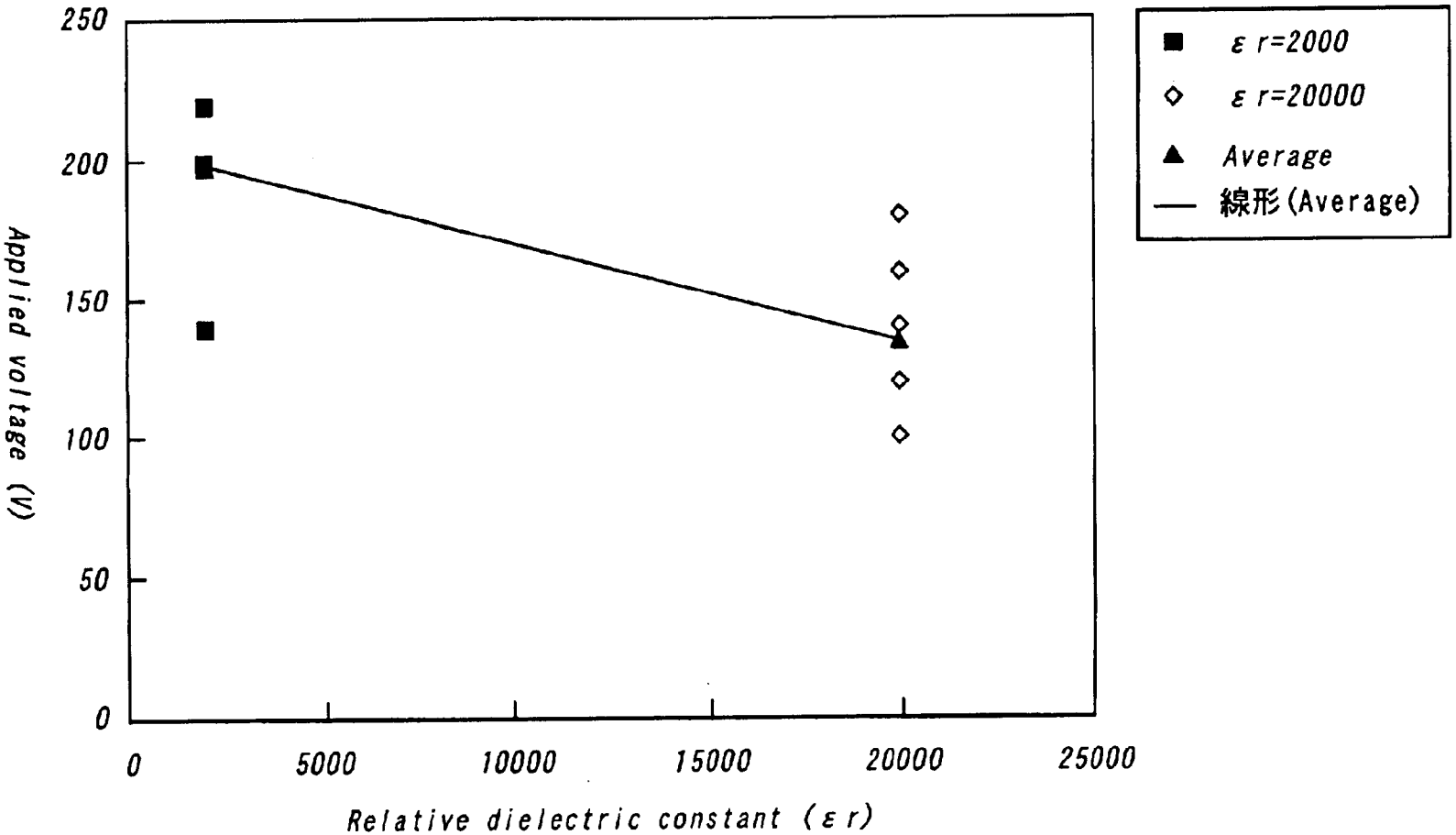
FIG. 10 is a diagram showing the relation between the relative dielectric constant of the electron-emitting element according to the present invention and the applied voltage to the electron-emitting element.
Figure 11:
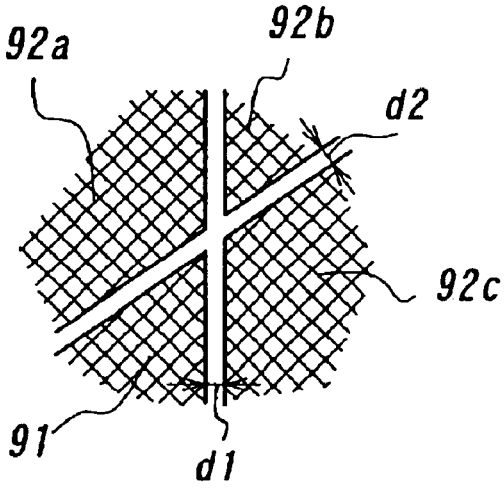
FIG. 11 is a diagram for explaining FIG. 10.

FIG. 10 is a diagram showing the relationship between the relative dielectric constant of an electron-emitting element according to the present invention and an applied voltage to it, and FIG. 11 is a diagram for explaining it. The characteristic of FIG. 10 shows the relationship between the relative dielectric constant of an electric field applying portion and the applied voltage required for emission of electrons in case that each of the widths d1 and d2 of slits formed by a driving electrode 91 and common electrodes 92*a* to 92*c* as shown in FIG. 11 is 10 $\mu$m.

As shown in FIG. 10, in the case of driving an electron-emitting element by means of a lower applied voltage compared with the conventional electron-emitting element, it is known that the relative dielectric constant is preferably not less than 1000.

Figure 12:
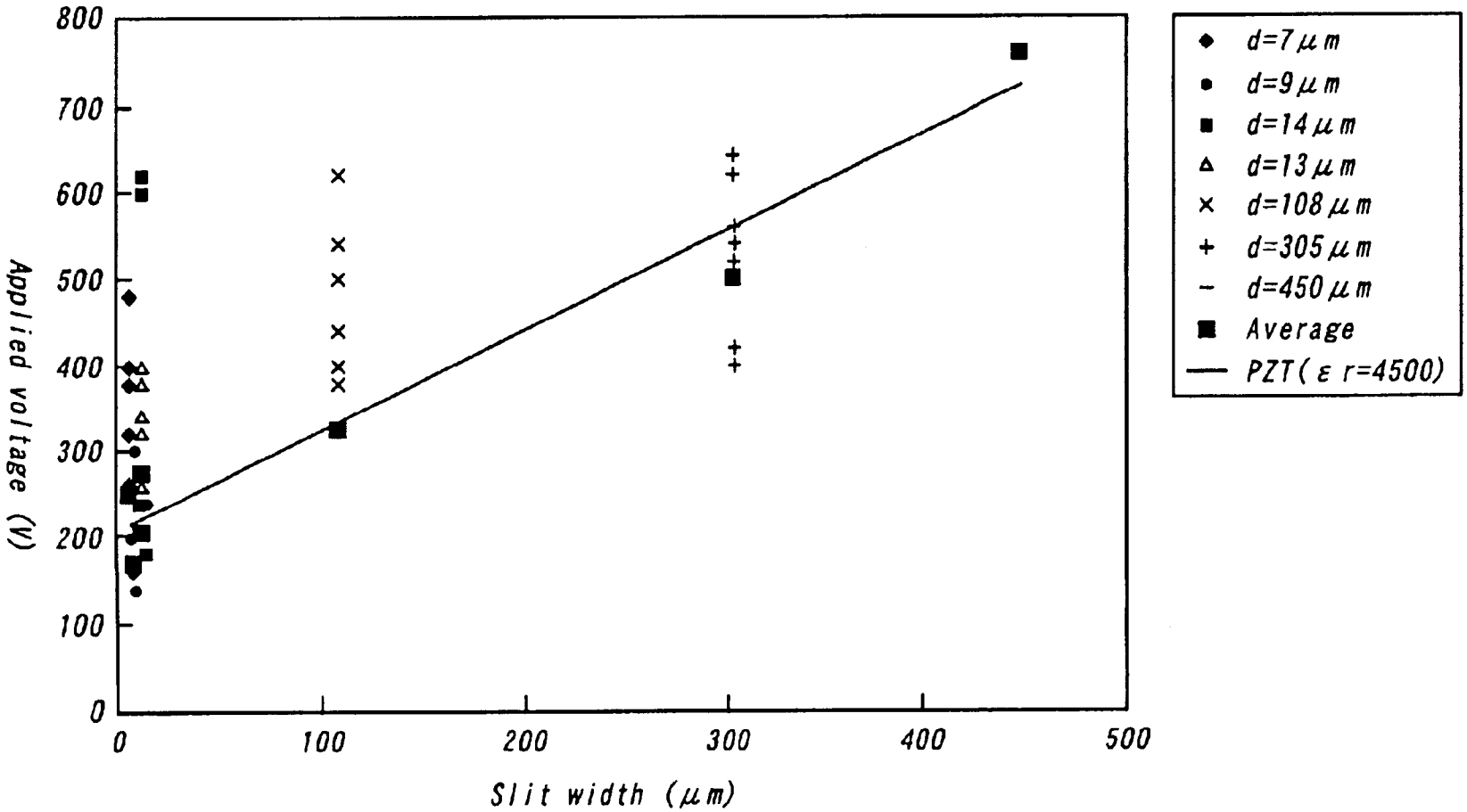
FIG. 12 is a diagram showing the relation between the slit width of the electron-emitting element according to the present invention and an applied voltage to the electron-emitting element.

FIG. 12 is a diagram showing the relationship between the width of a slit of the electron-emitting element according to the present invention and an applied voltage to it. From FIG. 12, it is known that it is necessary to make the slit width be not more than 500 $\mu$m in order to make electron emission phenomenon occur. In order to drive the electron-emitting element according to the present invention by means of a driver IC to be used in a plasma display, a fluorescent display tube or a liquid crystal display which are on the market, it is necessary to make the slit width be not more than 20 $\mu$m.

Figure 13A:
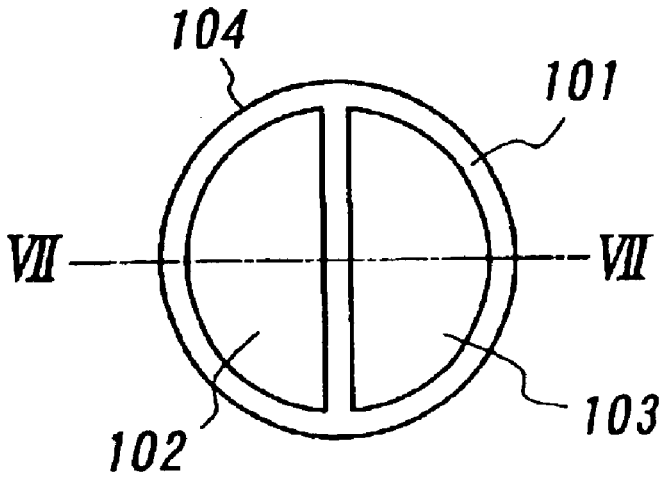
FIG. 13 is a diagram showing a seventh embodiment of the electron-emitting element according to the present invention.
Figure 13B:
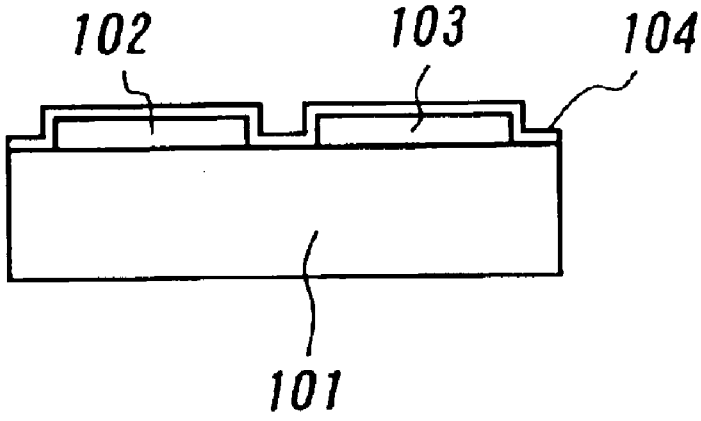

FIG. 13A is a top view of a seventh embodiment of the electron-emitting element according to the present invention, and FIG. 13B is a sectional view taken along line VII—VII. In this embodiment, a driving electrode 102 and a common electrode 103 each being in the shape of a semicircle are formed on one side of an electric field applying portion 101, and a conductive coating portion 104 is applied to the driving electrode 102, the common electrode 103 and a slit formed by them.

Figure 14A:
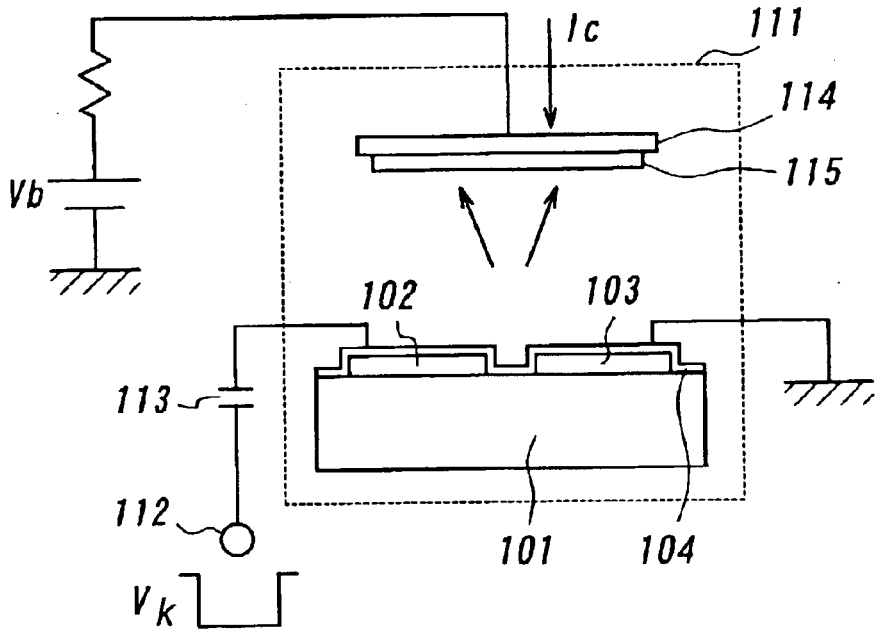
FIG. 14 is a diagram for explaining the operation of the electron-emitting element of FIG. 13.
Figure 14B:
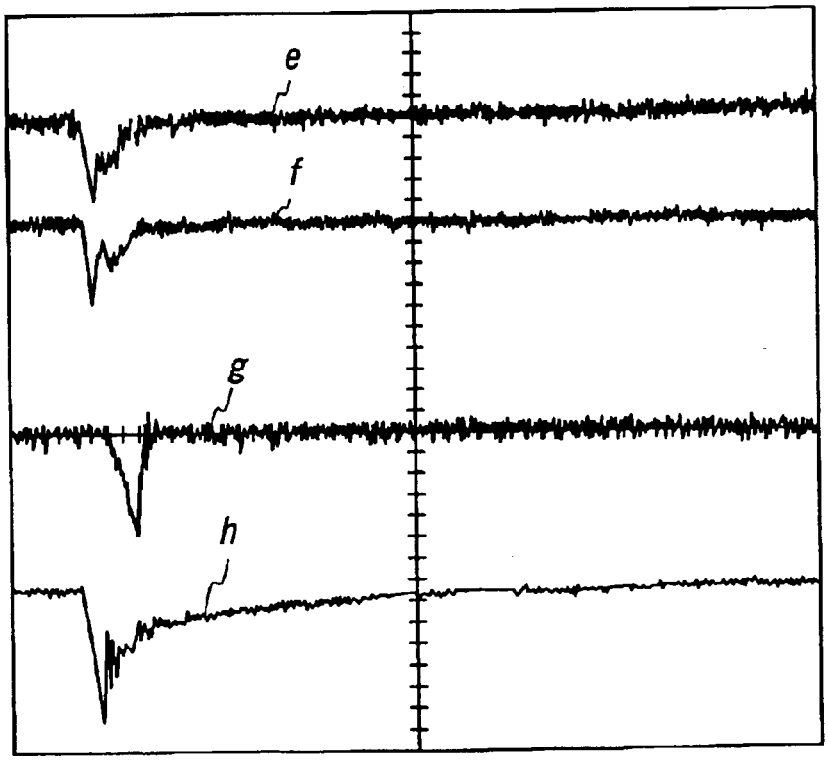

The operation of the electron-emitting element having the structure shown in FIG. 13 is described with reference to FIG. 14. In this case, the periphery of the electron-emitting element is kept in a vacuum state by a vacuum chamber 111. A capacitor 113 is arranged in series between the driving electrode 102 and the voltage signal source 112 in order to prevent short-circuit between the driving electrode 102 and the common electrode 103. An electron capturing electrode 114 opposite to the driving electrode 102 and the common electrode 103 has a phosphor 115 provided on it and has a bias voltage Vb applied to it.

The driving electrode 102 and the common electrode 103 are each an Au film of 3 $\mu$m in thickness, and a conductive coating portion 104 made of carbon (of 3 $\mu$m in film thickness) is applied to these driving electrode 102 and common electrode 103 and the slit part therebetween. In the case where a voltage Vk applied to the signal voltage source 112 is 25 V, the capacity of the capacitor 113 is 5 nF, a bias voltage Vb is 300 V, the electric field applying portion 101 is formed out of an electrostrictive material of 14,000 in relative dielectric constant, the width of a slit formed by the driving electrode 102 and the common electrode 103 is 10 $\mu$m, and the degree of vacuum inside the vacuum chamber 111 is $1\times10^{-3}$ Pa, a current Ic flowing through the electron capturing electrode 114 is 0.1 A and a current of about 40% of a current $I_1$, (0.25 A) flowing through the driving electrode 102 is taken as an electron current, and a voltage Vs between the driving electrode 102 and the common electrode 103, namely, a voltage required for emission of electrons is 23.8 V. As a result, according to the electron-emitting element shown in FIG. 13, a voltage necessary for emission of electrons can be remarkably lowered. And the conductive coating portion 104 reduces remarkably the possibility that the driving electrode 102 and the common electrode 103 are damaged by collision of electrons or ions, or by generation of heat. The waveforms of the current $I_1$, flowing through the driving electrode 102, the currents $I_2$, Ic flowing through the common electrode 103, and the voltage Vs are respectively shown by curves e to h in FIG. 14B.

The conductive coating 104 functions as a protective layer for the driving electrode 102 and/or the common electrode 103. Concretely, the conductive coating 104 prevents the ions and/or the electrons from colliding with the driving electrode 102 and/or the common electrode 103. Such ions and/or electrons occur near the slit when the electron is emitted, and after, these ions and/or electrons are accelerated by applying the voltage to the electron-emitting element. The conductive coating also prevents heat generation caused by such collisions from damaging the driving electrode 102 and/or the common electrode 103. In this respect, it is preferable that conductive coating 104 is composed of a material with a small sputtering yield and a high melting point.

The conductive coating 104 is composed of carbon or a conductor with resistance to a high-temperature oxidizing atmosphere, for example, a single metal, an alloy, a mixture of an insulating ceramic and a single metal, a mixture of an insulating ceramic and an alloy or the like, and is preferably composed of a high-melting point precious metal such as platinum, palladium, rhodium, molybdenum or the like, or a material having such an alloy as silver-palladium, silver-platinum, platinum-palladium or the like as its main ingredient, or a cermet material of platinum and ceramic. More preferably, it is composed of only platinum or a material having a platinum-based alloy as its main ingredient. And as a material for electrodes, carbon-based or graphite-based materials, for example, a diamond thin film, a diamond-like carbon and a carbon nanotube are also preferably used. A ceramic material added to the electrode material is preferably 5 to 30 vol %. Preferably, the conductive coating portion 104 has the resistance between several kΩ and 100 kΩ, for example. The conductive coating portion 104 is formed by a carbon membrane made by vacuum evaporation (for example, the membrane made from "CARBON 5PC" (made by SANYU KOGYO) by vacuum evaporation), rubbed-in carbon (for example, "FW200" (made by Degussa)), or printed carbon. A conductive layer that is coated by an alkaline metal oxide or alkaline-earth metals oxide film, especially magnesium oxide, is also preferably used as the conductive coating.

Figure 15A:
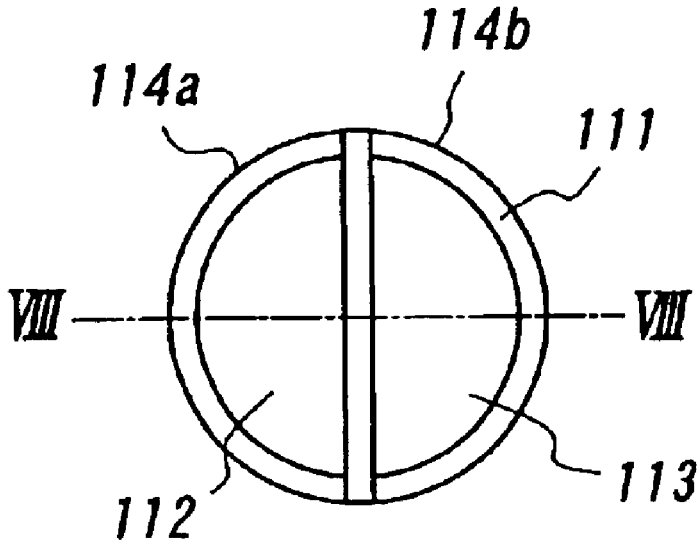
FIG. 15 is a diagram showing an eighth embodiment of the electron-emitting element according to the present invention.
Figure 15B:
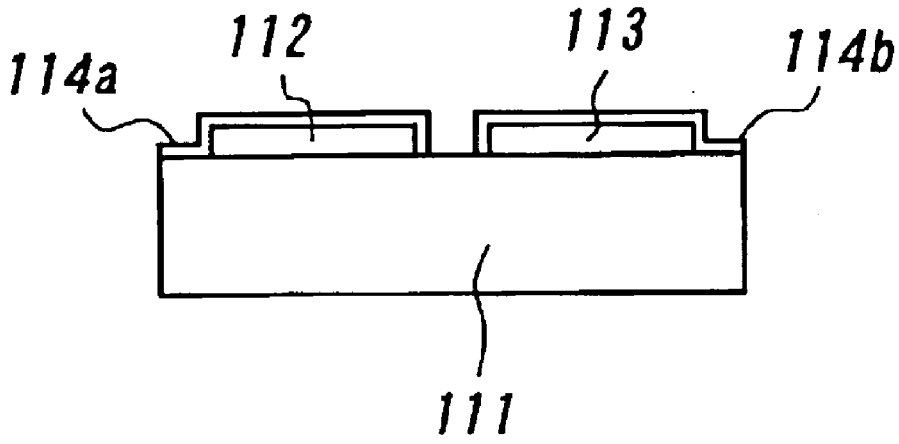

FIG. 15A is a top view of an eighth embodiment according to the present invention, and FIG. 15B is a sectional view of it taken along line VIII—VIII. This embodiment forms a semicircle-shaped driving electrode 112 and a common electrode 113 on one side of an electric field applying portion 111, forms a conductive coating portion 114*a* on the driving electrode 112, and forms a conductive coating portion 114*b* being in no contact with the conductive coating portion 114*a* on the common electrode 113.

Figure 16A:
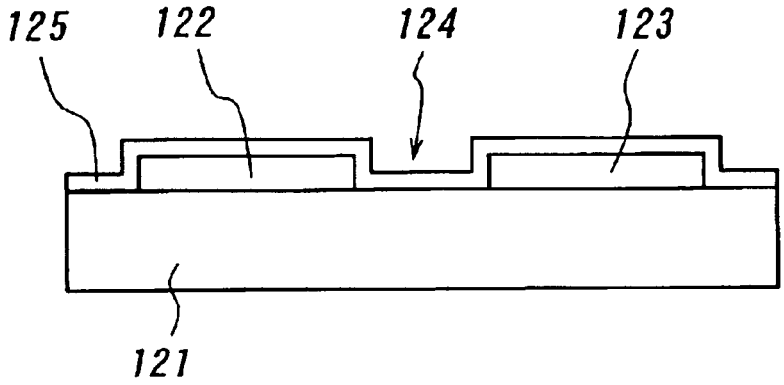
FIG. 16 is a diagram for explaining the operation of the electron-emitting element of FIG. 15.
Figure 16B:
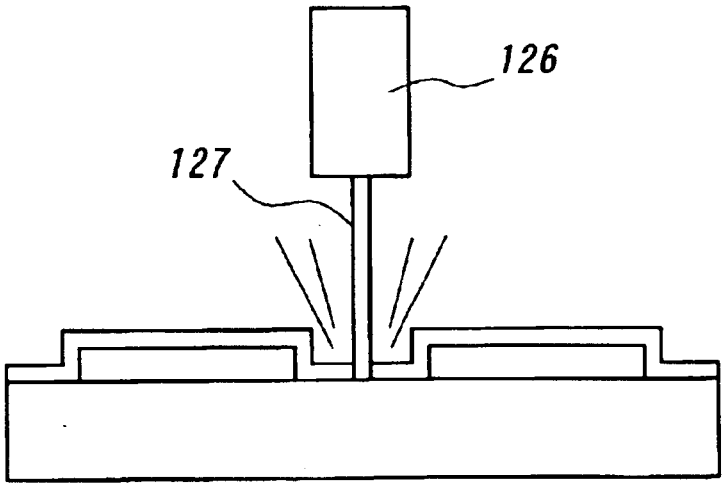
Figure 16C:
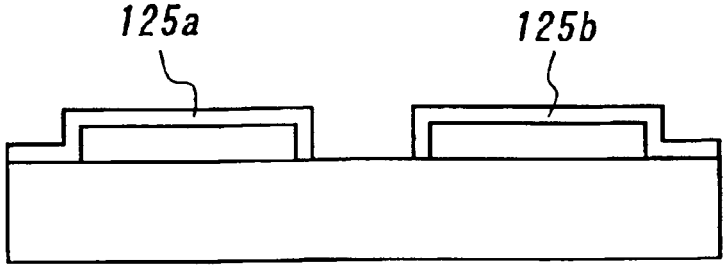

Such an electron-emitting element is obtained by forming a driving electrode 122 and a common electrode 123 on one side of an electric field applying portion 121 by means of printing and then forming a coating portion 125 by means of carbon-vapor deposition of a conductive material on the driving electrode 122, the common electrode 123 and a slit 124 formed by these electrodes to (FIG. 16A), irradiating the slit 124 with a laser beam 127 from a laser irradiating source 126 (FIG. 16B), and thereby forming a conductive coating portion 125*a* and a conductive coating portion 125*b* being in no contact with the conductive coating portion 125*a* An electron-emitting element having the structure shown in FIG. 16C can be also obtained by forming a driving electrode 122 and a common electrode 123 on one side of an electric field applying portion 121 by means of printing and then forming a conductive coating portion 125*a* and a conductive coating portion 125*b* that does not contact the conductive coating portion 125*a*, by means of printing. And an electron-emitting element of a structure shown in FIG. 16C can be also obtained by applying a thin-film technology such as photolithography.

Figure 17A:
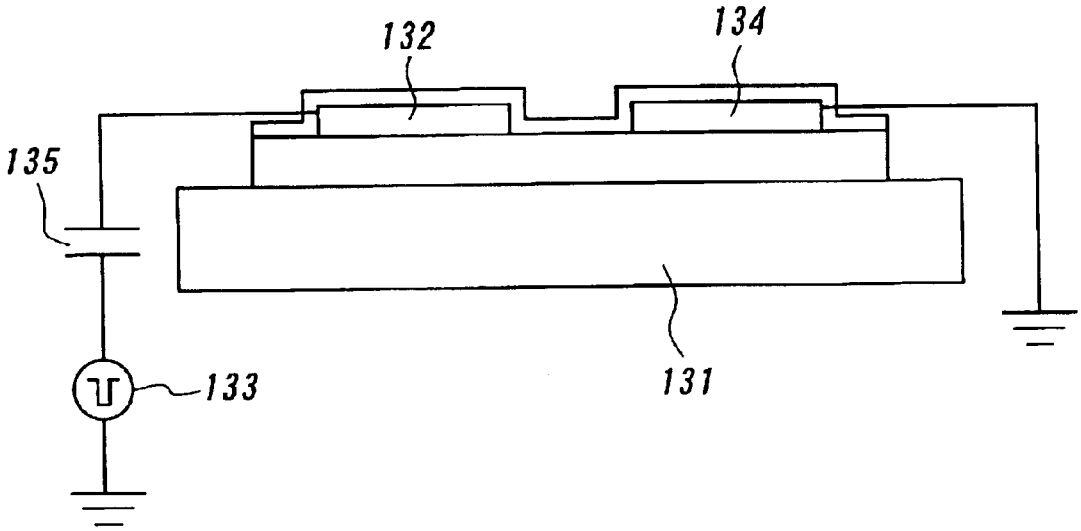
FIG. 17 is a diagram for explaining the effect of the electron-emitting element.
Figure 17B:
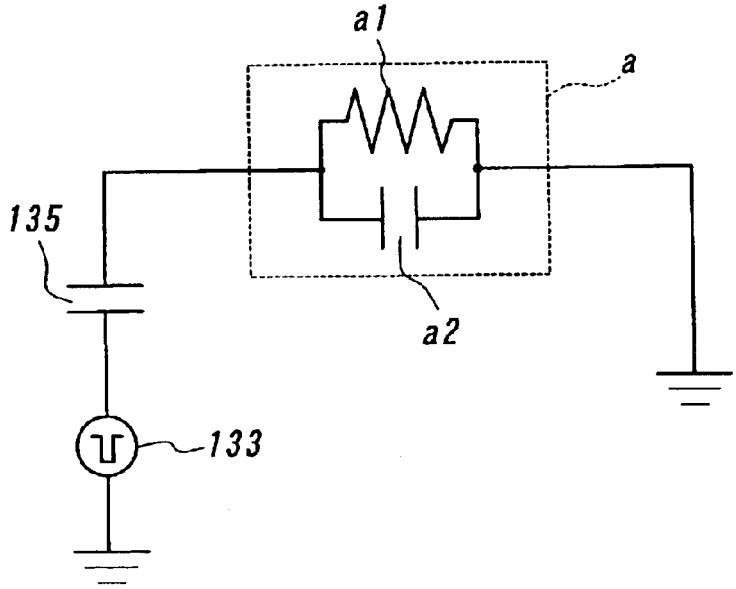
Figure 17C:
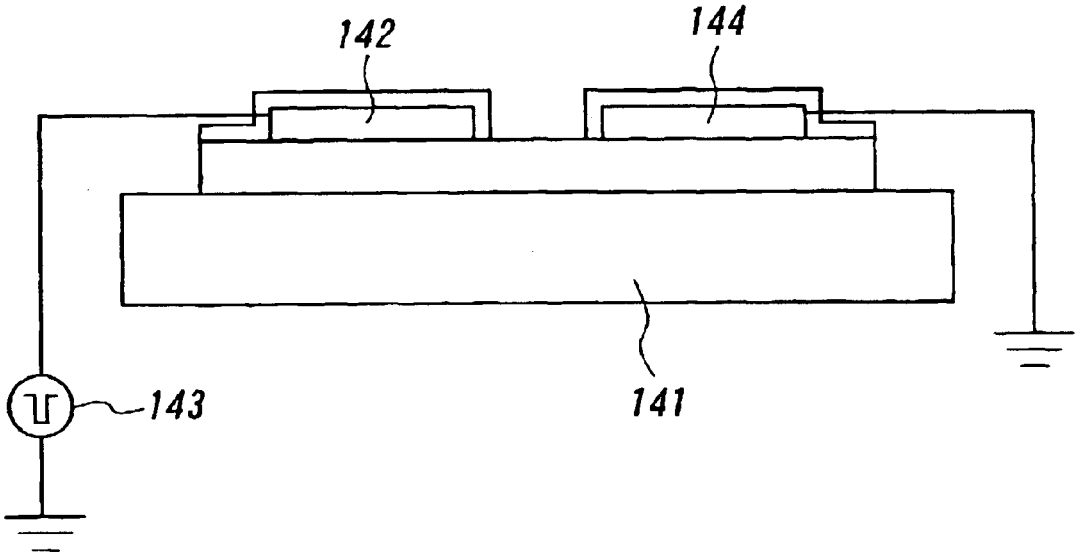
Figure 17D:
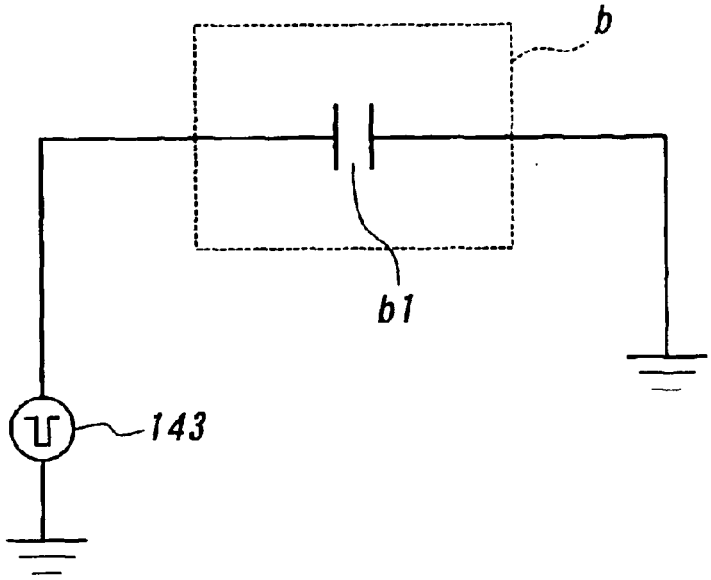

According to the eighth embodiment of an electron-emitting element of the present invention, the possibility of damaging the driving electrode and common electrode due to collisions or the heat generation from electrons or ions is remarkably reduced since first conductive coating portions and since the second conductive coating portion does not contact the first coating portion, and a driving voltage in the case of using the electron-emitting element in a driving circuit is greatly reduced. Such a great reduction in the driving voltage is described in detail. In case of arranging an electron-emitting element of the seventh embodiment on a zirconia substrate 131, connecting a driving electrode 132 to a signal voltage source 133 for generating a pulse-shaped signal and grounding a common electrode 134 (FIG. 17A), an equivalent circuit a between the driving electrode 132 and the common electrode 134 has a resistor a1 and a capacitor a2 connected in parallel with this resistor a1 (FIG. 17B). In order to prevent a direct current from flowing through the resistor a1, a capacitor 135 for cutting off a direct current is provided between the signal voltage source 133 and the electron-emitting element. On the contrary, in case of arranging an electron-emitting element of the eighth embodiment on a zirconia substrate 141, connecting a driving electrode 142 to a signal voltage source 143 for generating a pulse-shaped signal and grounding a common electrode 144 (FIG. 17C), an equivalent circuit b between the driving electrode 142 and the common electrode 144 has a capacitor b1 only (FIG. 17D). Since the equivalent circuit b has no resistor, it becomes unnecessary to provide a capacitor for cutting off a direct current between the signal voltage source 143 and the electron-emitting element. Since the driving voltage is not divided by a capacitor for cutting off a direct current, the driving voltage used in a driving circuit is more greatly reduced in comparison with the seventh embodiment and driving at a high voltage becomes unnecessary, and as a result, the circuit can be made lower in cost.

Figure 18A:
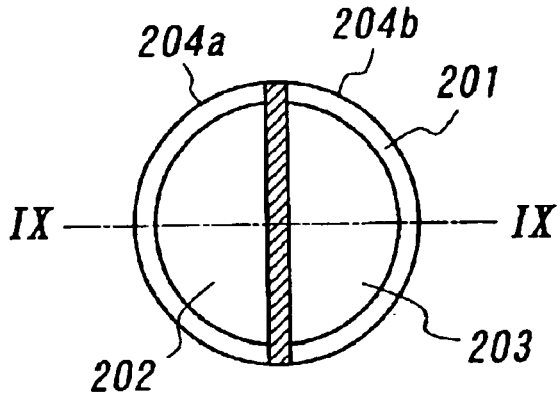
FIG. 18 is a diagram showing a ninth embodiment of the electron-emitting element according to the present invention.
Figure 18B:
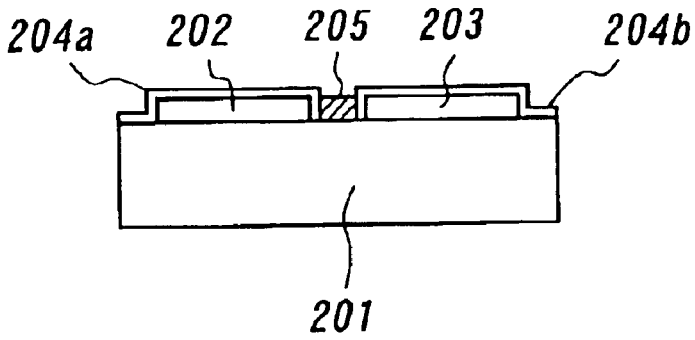

FIG. 18A is a top view of a ninth embodiment of an electron-emitting element according to the present invention, and FIG. 18B is a sectional view taken along line IX—IX. This embodiment forms a semicircle-shaped driving electrode 202 and a common electrode 203 on one side of an electric field applying portion 201, forms a conductive coating portion 204*a* on the driving electrode 202, and forms a conductive coating portion 204*b* being in no contact with the conductive coating portion 204*a* on the common electrode 203. And this electron-emitting element forms a high resistance portion 205 which is composed of a material that is higher in resistivity than the conductive coating portions 204*a* and 204*b* and that is in electrical contact with the conductive coating portions 204*a* and 204*b* in a slit formed by the driving electrode 202 and the common electrode 203.

Figure 18C:
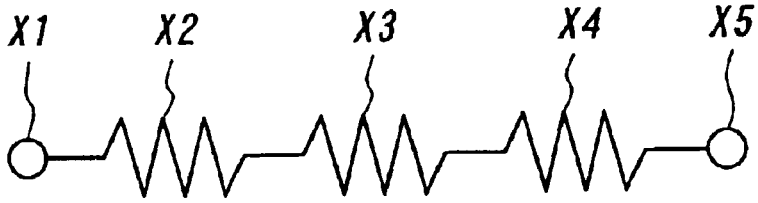

An equivalent circuit between the driving circuit 202 and the common electrode 203 includes, as shown in FIG. 18C, a terminal x1, resistors x2, x3 and x4 and a terminal x5 respectively corresponding to the driving electrode 202, the conductive coating portion 204*a*, the high resistance portion 205, the conductive coating portion 204*b* and the common electrode 203. When a voltage is applied to the electron-emitting element, the voltage of the high resistance portion 205 becomes higher than the voltage of the conductive coating portions 204*a* and 204*b*, and the degree of concentration of electric field in the high resistance portion, namely, in the slit is improved. As a result, it is possible to emit electrons at a low applied voltage, reduce the power consumption, miniaturize the circuit of the electron-emitting element and attain a cost reduction thanks to omitting high-voltage components.

Figure 19A:
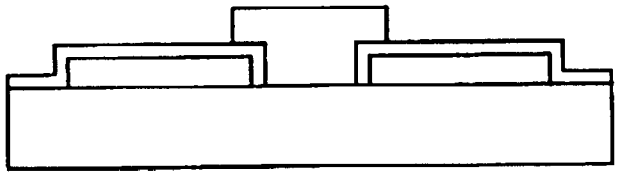
FIG. 19 is a diagram showing a variation of the electron-emitting element of FIG. 18.
Figure 19B:
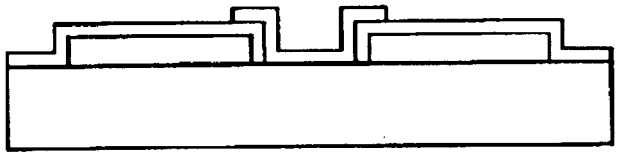
Figure 19C:
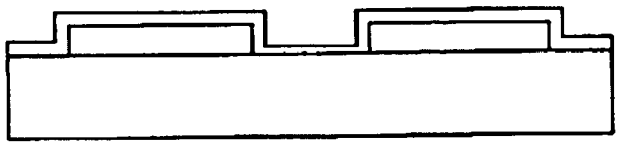
Figure 20A:
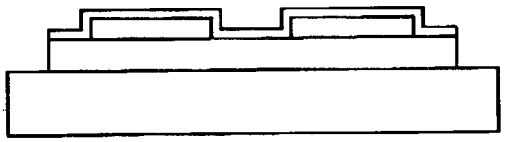
FIG. 20 is a diagram showing a tenth embodiment of the electron-emitting element according to the present invention.
Figure 20B:
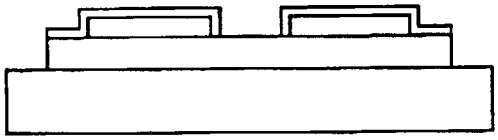
Figure 20C:
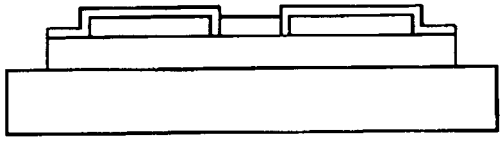
Figure 20D:
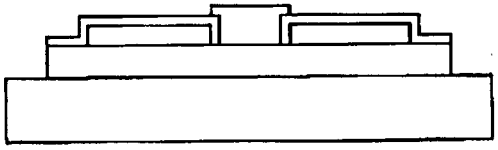
Figure 20E:
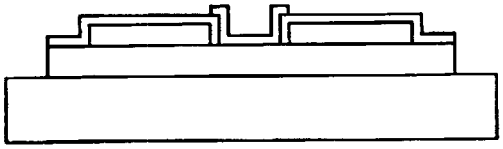
Figure 20F:
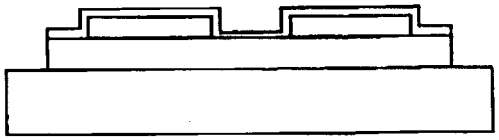

FIG. 19 is a diagram showing a variation example of the electron-emitting element of FIG. 18. In FIGS. 19A and 19B, a high resistance portion is provided which is composed of a material that is higher in resistivity than two conductive coating portions that do not contact each other. The high resistance portion is in electric contact with these conductive coating portions is provided in a slit formed by a driving electrode and a common electrode. In FIG. 19C, a high resistance portion is composed of the same material as two conductive coating portions that do not contact each other and is thinner in thickness than these conductive coating portions and is provided in a slit formed by a driving electrode and a common electrode. Such a high resistance portion can be obtained, for example, by irradiating the conductive coating portion on the slit with a laser and forming a conductive coating portion being thinner in thickness in comparison with the conductive coating portions formed on the driving and common electrodes.

FIG. 20 is a diagram showing a tenth embodiment of an electron-emitting element according to the present invention. This embodiment is an electron-emitting element provided on a zirconium oxide (zirconia) substrate, and on the zirconium oxide substrate there is arranged, for example, an electron-emitting element shown in FIG. 13 (FIG. 20A), an electron-emitting element shown in FIG. 15 (FIG. 20B), an electron-emitting element shown in FIG. 18 (FIG. 20C), an electron-emitting element shown in FIG. 19A (FIG. 20D), an electron-emitting element shown in FIG. 19B (FIG. 20E) or an electron-emitting element shown in FIG. 19C (FIG. 20F). As described already, forming a substrate out of zirconium oxide is preferable from the viewpoint of strength, tenacity and durability.

Figure 21A:
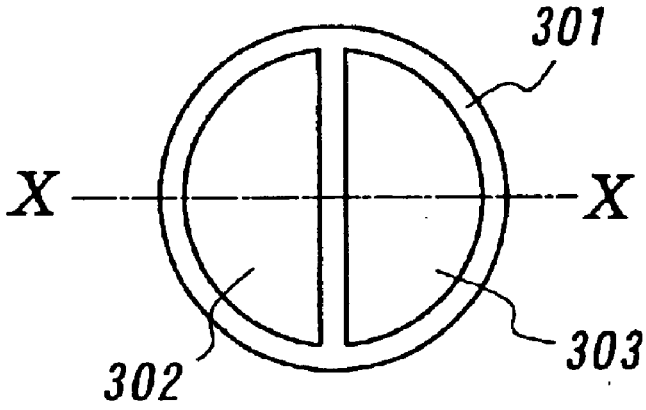
FIG. 21 is a diagram showing a eleventh embodiment of the electro-emitting element according to the present invention.
Figure 21B:
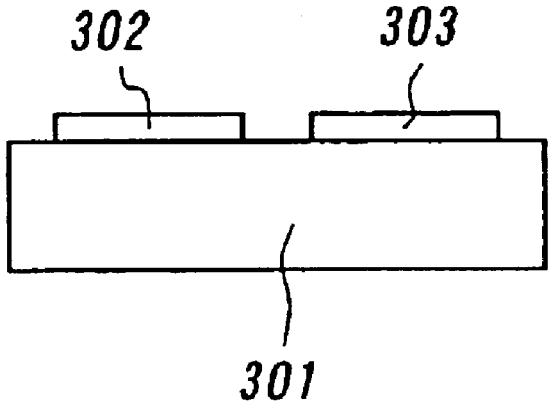

FIG. 21A is a top view of a eleventh embodiment of the electron-emitting element according to the present invention, and FIG. 21B is a sectional view taken along line X—X. In this embodiment, a driving electrode 302 and a common electrode 303 each having a semicircle shape, are formed on one side of an electric field applying portion 301.

Figure 22A:
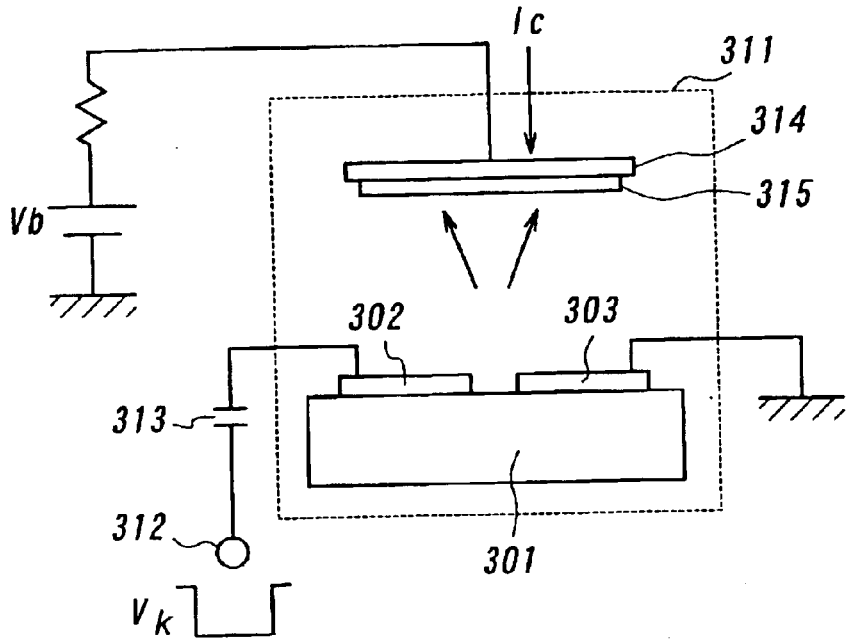
FIG. 22 is a diagram for explaining the operation of the electron-emitting element of FIG. 21.
Figure 22B:
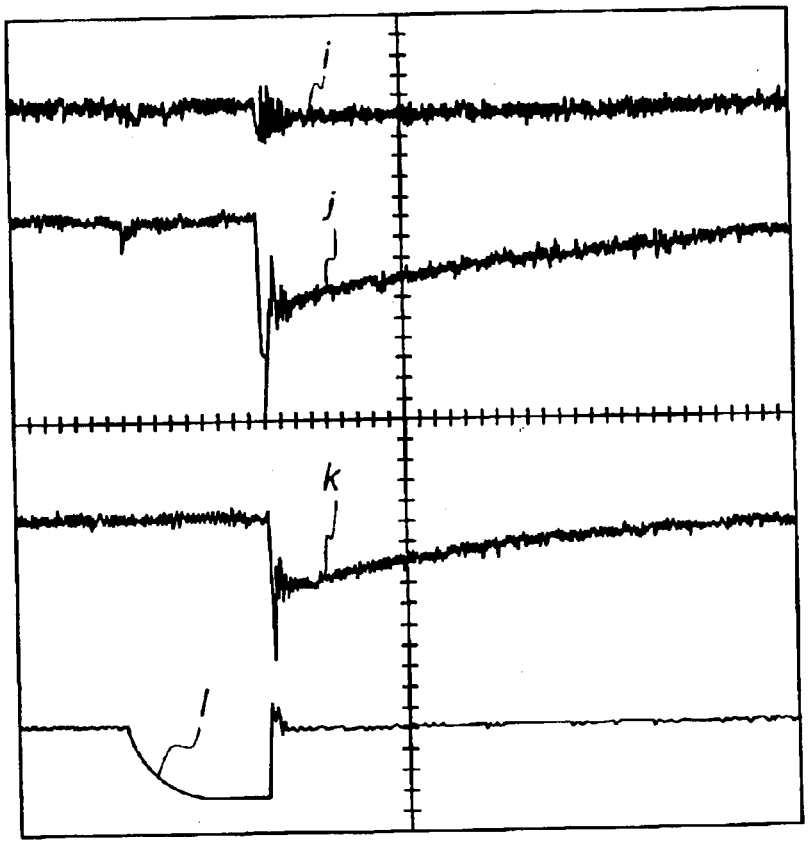

It is described with reference to FIG. 22 that electrons are emitted at a low vacuum of not more than 200 Pa also in case of an electron-emitting element having a structure shown in FIG. 21, namely, in case of having no carbon coating. In this case, the circumstance of the electron-emitting element is kept in a vacuum state by a vacuum chamber 311. A capacitor 313 is arranged in series between the driving electrode 302 and a voltage signal source 312. An electron capturing electrode 314 opposite to the driving electrode 302 and the common electrode 303 has a phosphor 315 provided on it and has a bias voltage Vb applied to it.

The material for both the driving electrode 302 and the common electrode 303 is Au, and in the case where a voltage Vk applied to the signal voltage source 312 is 160 V, the capacity of the capacitor 313 is 5 nF, the bias voltage Vb is 300 V, the electric field applying portion 301 is formed from an electrostrictive material of 4,500 in relative dielectric constant, the width of a slit formed by the driving electrode 302 and the common electrode 303 is 10 $\mu$m, and the degree of vacuum inside the vacuum chamber 311 is 200 Pa or less, a current Ic flowing through the electron capturing electrode 314 is 1.2 A and a current of about 60% of a current $I_1$ (2 A) flowing through the driving electrode 302 is taken as an electron current, and a voltage Vs between the driving electrode 302 and the common electrode 303, namely, a voltage required for emission of electrons becomes 153 V. The waveforms of the currents $I_1$, $I_2$ and Ic, and the voltage Vs are respectively shown by curves i to l in FIG. 22B.

It is the same also in case of having a carbon coating that a sufficient electron emission can be made at a very low vacuum of not more than 200 Pa as described above.

Since the electron-emitting element according to the present invention can emit electrons at a very low vacuum of not more than 200 Pa, in case of forming an FED, it is possible to make very small a sealed space of the outer circumferential part of a panel, and thus it is possible to realize a narrow-frame panel. And in case of make a large-sized display by arranging a plurality of panels, a joint between panels is made hard to be conspicuous. Further, in a conventional FED, the degree of vacuum of a space inside the FED is lowered by gas produced from a phosphor and the like, and there is the possibility that the durability of a panel receives a bad influence, but since a display using the electron-emitting element according to the present invention can emit electrons at a very low vacuum of not more than 200 Pa, a bad influence caused by lowering of the degree of vacuum of a space inside the FED is greatly reduced and the durability and reliability of the panel are greatly improved.

The electron-emitting element according to the present invention and the FED using it can be more simplified and made more small-sized in comparison with those of the prior art. Concretely explaining them, first, since the degree of vacuum in the space inside an FED can be made low, an enclosure supporting structure facing a pressure difference between the inside and the outside of the outer circumferential sealed part and the like of the FED can be simplified and miniaturized.

Since the applied voltage necessary for emitting electrons and the bias voltage to be applied to the electron capturing electrode can be made comparatively low, the FED does not need to be a pressure-resisting structure, and it is possible to miniaturize the whole display device and make the panel thin-sized. A bias voltage to be applied to the electron capturing electrode may be 0V.

Since the electric field applying portion of the electron-emitting element according to the present invention can be formed without the need of special processing, as required in case of forming an electron-emitting element of a Spindt type, and furthermore, the electrodes and the electric field applying portion can be formed by a thick film printing method, the electron-emitting element according to the present invention and the FED using it can be manufactured at a lower cost compared to those of the prior art.

Moreover, since the applied voltage necessary for emitting electrons and a bias voltage to be applied to an electron capturing electrode can be made comparatively low, the driving IC having a comparatively low dielectric strength, small-size and low cost can be used, and therefore, an FED using an electron-emitting element according to the present invention can be manufactured at low cost.

The present invention is not limited to the embodiments described above but can be variously modified and varied in many manners. For example, the electron-emitting element according to the present invention can be also applied to another application, such as backlighting. Since the electron-emitting element according to the present invention can emit a comparatively large amount of electron beam at a comparatively low voltage, it is preferable for forming a small-sized and high-efficiency sterilizer in place of a conventional sterilizer using mainly an ultraviolet ray emission method. The electron-emitting element according to the present invention can also adopt any other electrode structure having an angular part. Further, a resistor can be arranged in series between the second electrode, namely, the common electrode and a direct offset voltage source in order to prevent a short-circuit between the driving electrode and the common electrode.

In the sixth embodiment, the case where the electric field applying portions 51*a*, 51*b* are formed out of an antiferroelectric material has been described, but it is sufficient that the electric field applying portions 51*a*, 51*b* are formed out of at least one of a piezoelectric material, an electrostrictive material and an antiferroelectric material. In the case of using a piezoelectric material and/or an electrostrictive material, examples include materials having a lead zirconate (PZ-based) main ingredient, a material having nickel lead niobate as a main ingredient, a material having zinc lead niobate as a main ingredient, a material having manganese lead niobate as a main ingredient, a material having magnesium lead tantalate as a main ingredient, a material having nickel lead tantalate as a main ingredient, a material having antimony lead stannate as a main ingredient, a material having lead titanate as a main ingredient, a material having magnesium lead tungstate as a main ingredient, a material having cobalt lead niobate as a main ingredient, or a composite material containing an optional combination of these materials, and among them a ceramic material containing lead zirconate is most frequently used as a piezoelectric material and/or an electrostrictive material.

In the case of using a ceramic material as a piezoelectric material and/or an electrostrictive material, a proper material obtained by properly adding an oxide of lanthanum, barium, niobium, zinc, cerium, cadmium, chromium, cobalt, antimony, iron, yttrium, tantalum, tungsten, nickel, manganese, lithium, strontium, bismuth or the like, or a combination of some of these materials or other compounds to the ceramic material, for example, a material obtained by adding a specific additive to it so as to form a PZT-based material, are also preferably used.

Among these piezoelectric materials and/or electrostrictive materials, a material having a main ingredient including a component consisting of magnesium lead niobate, lead zirconate and lead titanate, a material having as its main ingredient a component consisting of nickel lead niobate, magnesium lead niobate, lead zirconate and lead titanate, a material having as its main ingredient a component consisting of magnesium lead niobate, nickel lead tantalate, lead zirconate and lead titanate, a material having as its main ingredient a component consisting of magnesium lead tantalate, magnesium lead niobate, lead zirconate and lead titanate, and a material substituting strontium and/or lanthanum for some part of lead in these materials and the like are preferably used. These materials are preferred when the electric field applying portions 51*a*, 51*b* are formed by means of a thick film forming technique, such as a screen printing method and the like as described above.

In the case of a multiple-component piezoelectric material and/or electrostrictive material, the piezoelectric and/or electrostrictive characteristics vary depending upon the composition of the components, and a three-component material of magnesium lead niobate-lead zirconate-lead titanate, or a four-component material of magnesium lead niobate-nickel lead tantalate-lead zirconate-lead titanate or a four-component material of magnesium lead tantalate-magnesium lead niobate-lead zirconate-lead titanate preferably has a composition in the vicinity of the phase boundary of pseudo-cubic system-tetragonal system-rhombohedral system, and particularly the composition of magnesium lead niobate of 15 to 50 mol %, lead zirconate of 10 to 45 mol % and lead titanate of 30to 45 mol %, the composition of magnesium lead niobate of 15 to 50 mol %, nickel lead tantalate of 10 to 40 mol %, lead zirconate of 10 to 45 mol % and lead titanate of 30 to 45 mol %, and the composition of magnesium lead niobate of 15 to 50 mol %, magnesium lead tantalate of 10 to 40 mol %, lead zirconate of 10 to 45 mol % and lead titanate of 30 to 45 mol % are preferably adopted for the reason that they have a high piezoelectric constant and a high electro-mechanical coupling coefficient.

In the ninth embodiment, the high resistance portion may be made of a material having a conductive material sparsely distributed in it, a material having an altered structure that is locally changed by locally destroying, deforming or changing a property of a conductive material in it, a material having a changed structure or microcracked structure achieved by processing a conductive coating portion by applying of a high voltage or the like and by locally destroying, deforming or changing a property of a conductive material in it, a material whose resistance value is made high by a fact that the slit expands due to a piezoelectric effect only when applying an electric field, or a material whose resistance value is made high by a fact that it is microcracked due to a piezoelectric effect. In the case of using a material whose resistance value is made high by the fact that the slit expands due to a piezoelectric effect only when applying an electric field as the high resistance portion, there is an advantage of making it possible to omit a pre-processing step during manufacturing an electron-emitting element.

What is claimed is:

1. An electron-emitting element comprising:

an electric field applying portion comprising a dielectric;

a first electrode formed on one surface of said electric field applying portion; and a second electrode formed on said one surface of said electric field applying portion and forming a slit in cooperation with said first electrode;

wherein a conductive coating portion is applied to said first electrode, said second electrode and said slit; and wherein said electric field applying portion has a relative dielectric constant of not less than 1000.

2. The electron-emitting element according to claim 1, further comprising a third electrode arranged at a certain space with respect to said first and second electrodes, wherein said space between said first and second electrodes and said third electrode is a vacuum.

3. The electron-emitting element according to claim 2, further comprising:

a voltage source for applying a direct offset voltage to said third electrode; and a resistor arranged in series between said voltage source and said third electrode.

4. An electron-emitting element comprising:

an electric field applying portion comprising a dielectric;

a first electrode formed on one surface of said electric field applying portion; and a second electrode formed on said one surface of said electric field applying portion and forming a slit in cooperation with said first electrode;

wherein a first conductive coating portion is provided on said first electrode, and a second conductive coating portion is provided on said second electrode;

wherein, a non-contact condition is provided between said first conductive coating portion and said second conductive coating portion; and wherein said electric field applying portion has a relative dielectric constant of not less than 1000.

5. The electron-emitting element according to claim 4, further comprising a high resistance portion provided on said slit, said high resistance portion having a higher resistance than those of said first and said second conducting coating portions and said high resistance portion being in electrical contact with said first and said second conducting coating portions.

6. The electron-emitting element according to claim 4, further comprising a third electrode arranged at a certain space with respect to said first and second electrodes, wherein said space between said first and second electrodes and said third electrode is a vacuum.

7. The electron-emitting element according to claim 6, further comprising:

a voltage source for applying a direct offset voltage to said third electrode; and a resistor arranged in series between said voltage source and said third electrode.

8. An electron-emitting element comprising:

an electric field applying portion comprising at least one of a piezoelectric material, an electrostrictive material and an antiferroelectric material;

a first electrode formed on one surface of said electric field applying portion; and a second electrode formed on said one surface of said electric field applying portion and forming a slit in cooperation with said first electrode;

wherein a conductive coating portion is applied to said first electrode, said second electrode and said slit.

9. The electron-emitting element according to claim 8, further comprising a third electrode arranged at a certain space with respect to said first and second electrodes, wherein said space between said first and second electrodes and said third electrode is a vacuum.

10. The electron-emitting element according to claim 9, wherein said electric field applying portion also acts an actuator and controls the quantity of emitted electrons by the displacement motion of said electric field applying portion.

11. The electron-emitting element according to claim 9, further comprising:

a voltage source for applying a direct offset voltage to said third electrode; and a resistor arranged in series between said voltage source and said third electrode.

12. An electron-emitting element comprising:

an electric field applying portion comprising at least one of a piezoelectric material, an electrostrictive material and an antiferroelectric material;

a first electrode formed on one surface of said electric field applying portion; and a second electrode formed on said one surface of said electric field applying portion and forming a slit in cooperation with said first electrode;

wherein a first conductive coating portion is provided on said first electrode; and a second conductive coating portion is provided on said second electrode; and wherein, a non-contact condition is provided between said first conductive coating portion and said second conductive coating portion.

13. The electron-emitting element according to claim 12, further comprising a high resistance portion with a high resistance being provided on said slit, said high resistance portion having a higher resistance than those of said first and said second conducting coating portions and said high resistance portion being in electrical contact with said first and said second conducting coating portions.

14. The electron-emitting element according to claim 12, further comprising a third electrode arranged at a certain space with respect to said first and second electrodes, wherein said space between said first and second electrodes and said third electrode is a vacuum.

15. The electron-emitting element according to claim 12, wherein said electric field applying portion also acts an actuator and controls the quantity of emitted electrons by the displacement motion of said electric field applying portion.

16. The electron-emitting element according to claim 14, further comprising:

a voltage source for applying a direct offset voltage to said third electrode; and a resistor arranged in series between said voltage source and said third electrode.

17. A field emission display comprising:

a plurality of electron-emitting elements arranged in two dimensions; and a plurality of phosphors each being arranged with a certain space with respect to each of said electron-emitting elements;

wherein each of said electron-emitting elements comprises;

an electric field applying portion made of a dielectric, a first electrode formed on one surface of said electric field applying portion, and a second electrode formed on said one surface of said electric field applying portion and forming a slit in cooperation with said first electrode;

wherein a conductive coating portion is applied to said first electrode, said second electrode and said slit; and wherein said electric field applying portion has a relative dielectric constant of not less than 1000.

18. The field emission display according to claim 17, further comprising a third electrode arranged on an opposite surface to a surface of each of said phosphors facing said first and second electrodes, and said space between said first and second electrodes and said phosphor is a vacuum.

19. The field emission display according to claim 18, wherein each of said electron-emitting elements further comprises:

a voltage source for applying a direct offset voltage to said third electrode; and a resistor arranged in series between said voltage source and said third electrode.

20. A field emission display comprising:

a plurality of electron-emitting elements arranged in two dimensions; and a plurality of phosphors each being arranged with a certain space with respect to each of said electron-emitting elements;

wherein each of said electron-emitting elements comprises:

an electric field applying portion made of a dielectric, a first electrode formed on one surface of said electric field applying portion, and a second electrode formed on said one surface of said electric field applying portion and forming a slit in cooperation with said first electrode;

wherein a first conductive coating portion is provided on said first electrode; and a second conductive coating portion is provided on said second electrode;

wherein, a non-contact condition is provided between said first conductive coating portion and said second conductive coating portion; and wherein said electric field applying portion has a relative dielectric constant of not less than 1000.

21. The field emission display according to claim 20, wherein each of said electron-emitting elements further comprises:

a high resistance portion provided on said slit, said high resistance portion having a higher resistance than those of said first and said second conducting coating portions and said high resistance portion being in electrical contact with said first and said second conducting coating portions.

22. The field emission display according to claim 20, further comprising a third electrode arranged on an opposite surface to a surface of each of said phosphors facing said first and second electrodes, and said space between said first and second electrodes and said phosphor is a vacuum.

23. The field emission display according to claim 22, wherein each of said electron-emitting elements further comprises:

a voltage source for applying a direct offset voltage to said third electrode; and a resistor arranged in series between said voltage source and said third electrode.

24. A field emission display comprising:

a plurality of electron-emitting elements arranged in two dimensions; and a plurality of phosphors each being arranged with a certain space with respect to each of said electron-emitting elements;

wherein each of said electron-emitting elements comprises an electric field applying portion comprising at least one of a piezoelectric material, an electrostrictive material and an antiferroelectric material, a first electrode formed on one surface of said electric field applying portion, and a second electrode foamed on said one surface of said electric field applying portion and forming a slit in cooperation with said first electrode;

wherein a conductive coating is applied to said first electrode, said second electrode and said slit.

25. The field emission display according to claim 24, further comprising a third electrode arranged on an opposite surface to a surface of each of said phosphors facing said first and second electrodes, and said space between said first and second electrodes and said phosphor is a vacuum.

26. The field emission display according to claim 24, wherein said electric field applying portion also acts as an actuator and controls the quantity of emitted electrons by the displacement motion of said electric field applying portion.

27. The field emission display according to claim 25, wherein each of said electron-emitting elements further comprises:

a voltage source for applying a direct offset voltage to said third electrode; and a resistor arranged in series between said voltage source and said third electrode.

28. A field emission display comprising:

a plurality of electron-emitting elements arranged in two dimensions; and a plurality of phosphors each being arranged with a certain space with respect to each of said electron-emitting elements;

wherein each of said electron-emitting elements comprises an electric field applying portion comprising at least one of a piezoelectric material, an electrostrictive material and an antiferroelectric material, a first electrode formed on one surface of said electric field applying portion, and a second electrode formed on said one surface of said electric field applying portion and forming a slit in cooperation with said first electrode;

wherein a first conductive coating portion is provided on said first electrode; and a second conductive coating portion is provided on said second electrode; and wherein, a non-contact condition is provided between said first conductive coating portion and said second conductive coating portion.

29. The field emission display according to claim 28, wherein each of said electron-emitting elements further comprises:

a high resistance portion provided on said slit, said high resistance portion having a higher resistance than those of said first and said second conducting coating portions and said high resistance portion being in electrical contact with said first and said second conducting coating portions.

30. The field emission display according to claim 28, further comprising a third electrode arranged on an opposite surface to a surface of each of said phosphors facing said first and second electrodes, and said space between said first and second electrodes and said phosphor is a vacuum.

31. The field emission display according to claim 28, wherein said electric field applying portion also acts as an actuator and controls the quantity of emitted electrons by the displacement motion of said electric field applying portion.

32. The field emission display according to claim 30, wherein each of said electron-emitting elements further comprises:

a voltage source for applying a direct offset voltage to said third electrode; and a resistor arranged in series between said voltage source and said third electrode.

* * * * *

UNITED STATES PATENT AND TRADEMARK OFFICE

CERTIFICATE OF CORRECTION

PATENT NO. : 6,936,972 B2
DATED : August 30, 2005
INVENTOR(S) : Yukihisa Takeuchi et al.

It is certified that error appears in the above-identified patent and that said Letters Patent is hereby corrected as shown below:

Column 23,
Line 45, delete “with a high”.
Line 46, delete “resistance being”.

Column 24,
Line 46, delete “;”.
Line 47, delete “,”.

Column 25,
Line 21, change “foamed” to -- formed --.

Column 26,
Line 16, delete “;”.
Line 17, delete “,”.

Signed and Sealed this

Third Day of January, 2006

JON W. DUDAS
*Director of the United States Patent and Trademark Office*